US011022146B2

(12) United States Patent
Mogridge et al.

(10) Patent No.: US 11,022,146 B2
(45) Date of Patent: Jun. 1, 2021

(54) FAN ASSEMBLY

(71) Applicant: Dyson Technology Limited, Wiltshire (GB)

(72) Inventors: Thomas Richard Mogridge, Bristol (GB); Ryan Alexander Hughes, Bristol (GB); James Gregory Forrest, Bristol (GB); Steven Eduard Peet, Bristol (GB); Joseph Robert Carling, Swindon (GB); James Henry Campbell Terry-Collins, Swindon (GB)

(73) Assignee: Dyson Technology Limited, Malmesbury (GB)

( * ) Notice: Subject to any disclaimer, the term of this patent is extended or adjusted under 35 U.S.C. 154(b) by 13 days.

(21) Appl. No.: 16/204,726

(22) Filed: Nov. 29, 2018

(65) Prior Publication Data

US 2019/0170157 A1 Jun. 6, 2019

(30) Foreign Application Priority Data

Dec. 1, 2017 (GB) ..... 1720058

(51) Int. Cl.
*F04D 29/56* (2006.01)
*F04F 5/16* (2006.01)
(Continued)

(52) U.S. Cl.
CPC ..... *F04D 29/563* (2013.01); *F04D 19/002* (2013.01); *F04D 25/08* (2013.01);
(Continued)

(58) Field of Classification Search
CPC .. F04D 29/563; F04D 29/4246; F04D 29/547; F04D 29/705; F04D 19/002;
(Continued)

(56) References Cited

U.S. PATENT DOCUMENTS 2,488,467 A 11/1949 De Lisio
6,156,085 A 12/2000 Chiu et al.
(Continued)

FOREIGN PATENT DOCUMENTS

CN 102011755 A 4/2011
CN 102235385 11/2011
(Continued)

OTHER PUBLICATIONS

Search Report dated Jun. 1, 2018, directed to GB Application No. 1720058.5; 1 page.
(Continued)

*Primary Examiner* — Eldon T Brockman
*Assistant Examiner* — Michael K. Reitz
(74) *Attorney, Agent, or Firm* — Morrison & Foerster LLP

(57) ABSTRACT

There is provided a fan assembly comprising a motor-driven impeller for creating an airflow and a nozzle comprising a first air outlet. The nozzle defines a bore through which air from outside the fan assembly is drawn by any portion of the airflow that is emitted from the first outlet and which combines with the airflow emitted from the first air outlet to produce an amplified airflow. The fan assembly further comprises a second air outlet arranged such that any portion of the airflow that is emitted from the second air outlet does not draw air through the bore defined by the nozzle thereby producing a non-amplified airflow.

25 Claims, 17 Drawing Sheets

(51) Int. Cl.

| | |
|---|---|
| ***F04D 29/42*** | (2006.01) |
| ***F04D 25/08*** | (2006.01) |
| ***F04D 19/00*** | (2006.01) |
| ***F04D 29/54*** | (2006.01) |

(52) U.S. Cl.
CPC ..... *F04D 29/4246* (2013.01); *F04D 29/547* (2013.01); *F04F 5/16* (2013.01); *F05D 2250/52* (2013.01)

(58) Field of Classification Search
CPC ..... F04D 25/08; F04F 5/16; F24F 6/14; F24F 2006/143
See application file for complete search history.

(56) References Cited

U.S. PATENT DOCUMENTS

| | | | |
|---|---|---|---|
| 6,447,586 | B1 | 9/2002 | Campbell |
| 9,127,689 | B2 | 9/2015 | Gammack et al. |
| 2006/0016335 | A1 | 1/2006 | Cox et al. |
| 2013/0028766 | A1 | 1/2013 | Staniforth et al. |
| 2013/0243588 | A1 | 9/2013 | Lo |
| 2014/0348658 | A1 | 11/2014 | Cunnane |
| 2016/0032941 | A1 | 2/2016 | Beavis et al. |
| 2016/0121695 | A1 | 5/2016 | Sakurai |
| 2016/0215782 | A1 | 7/2016 | Xie et al. |
| 2016/0238039 | A1 | 8/2016 | Stewart et al. |
| 2019/0170162 | A1 | 6/2019 | Jennings |

FOREIGN PATENT DOCUMENTS

| | | | |
|---|---|---|---|
| CN | 202228388 | | 5/2012 |
| CN | 202545295 | | 11/2012 |
| CN | 203272264 | | 11/2013 |
| CN | 105317663 | | 2/2016 |
| DE | 102014017774 | | 6/2016 |
| GB | 2493975 | | 2/2013 |
| GB | 2493976 | | 2/2013 |
| GB | 2484761 | B | 8/2013 |
| GB | 2536767 | | 9/2016 |
| JP | 2013-15114 | A | 1/2013 |
| JP | 5828134 | B2 | 12/2015 |
| JP | 2017-172358 | | 9/2017 |
| KR | 10-2014-0094414 | | 7/2014 |
| KR | 10-1600701 | | 3/2016 |
| TW | 336963 | | 8/1999 |
| WO | 03/009735 | | 2/2003 |
| WO | 2010/100451 | | 9/2010 |
| WO | 2013/173830 | | 11/2013 |

OTHER PUBLICATIONS

International Search Report and Written Opinion dated Jan. 4, 2019, directed to International Application No. PCT/GB2018/052821; 14 pages.

Jennings et al., U.S. Office Action dated May 27, 2020, directed to U.S. Appl. No. 16/204,732; 10 pages.

First Office Action dated Dec. 26, 2019, directed to CN Application No. 201811443863.0; 18 pages.

FAN ASSEMBLY

REFERENCE TO RELATED APPLICATIONS

This application claims the priority of United Kingdom Application No. 1720058.5, filed Dec. 1, 2017, the entire contents of which are incorporated herein by reference.

FIELD OF THE INVENTION

The present invention relates to a fan assembly and a nozzle for a fan assembly.

BACKGROUND OF THE INVENTION

A conventional domestic fan typically includes a set of blades or vanes mounted for rotation about an axis, and drive apparatus for rotating the set of blades to generate an airflow. The movement and circulation of the airflow creates a 'wind chill' or breeze and, as a result, the user experiences a cooling effect as heat is dissipated through convection and evaporation. The blades are generally located within a cage which allows an airflow to pass through the housing while preventing users from coming into contact with the rotating blades during use of the fan.

U.S. Pat. No. 2,488,467 describes a fan which does not use caged blades to project air from the fan assembly. Instead, the fan assembly comprises a base which houses a motor-driven impeller for drawing an airflow into the base, and a series of concentric, annular nozzles connected to the base and each comprising an annular outlet located at the front of the nozzle for emitting the airflow from the fan. Each nozzle extends about a bore axis to define a bore about which the nozzle extends.

Each nozzle is in the shape of an airfoil may therefore be considered to have a leading edge located at the rear of the nozzle, a trailing edge located at the front of the nozzle, and a chord line extending between the leading and trailing edges. In U.S. Pat. No. 2,488,467 the chord line of each nozzle is parallel to the bore axis of the nozzles. The air outlet is located on the chord line, and is arranged to emit the airflow in a direction extending away from the nozzle and along the chord line.

Another fan assembly which does not use caged blades to project air from the fan assembly is described in WO 2010/100451. This fan assembly comprises a cylindrical base which also houses a motor-driven impeller for drawing a primary airflow into the base, and a single annular nozzle connected to the base and comprising an annular mouth/outlet through which the primary airflow is emitted from the fan. The nozzle defines an opening through which air in the local environment of the fan assembly is drawn by the primary airflow emitted from the mouth, amplifying the primary airflow. The nozzle includes a Coanda surface over which the mouth is arranged to direct the primary airflow. The Coanda surface extends symmetrically about the central axis of the opening so that the airflow generated by the fan assembly is in the form of an annular jet having a cylindrical or frusto-conical profile.

SUMMARY OF THE INVENTION

It is an object of the present invention to provide a fan assembly that can deliver either an amplified airflow or a non-amplified airflow or simultaneously deliver both an amplified airflow and a non-amplified airflow, and in doing so provide the user of the fan assembly with various options as to how air is delivered by the fan assembly. This is particularly useful when the fan assembly is configured to provide purified air as the user of a fan assembly may wish to continue to receive purified air from the fan assembly without the cooling effect produced by the provision of the amplified airflow.

According a first aspect there is provided a fan assembly comprising a motor-driven impeller for creating an airflow and a nozzle comprising a first air outlet. The nozzle defines a bore through which air from outside the fan assembly is drawn by any portion of the airflow that is emitted from the first outlet and which combines with the airflow emitted from the first air outlet to produce an amplified airflow. The fan assembly further comprises a second air outlet arranged such that any portion of the airflow that is emitted from the second air outlet does not draw air through the bore defined by the nozzle thereby producing a non-amplified airflow. The second air outlet may be arranged to direct any portion of the airflow that is emitted from the second air outlet such that the non-amplified airflow divaricates away from the fan assembly.

The airflow drawn through the fan assembly by the motor-driven impeller and emitted from the fan assembly by one or both of the first air outlet and the second air outlet is referred to hereafter as a primary airflow. Any portion of this primary airflow that is emitted from the first air outlet entrains air surrounding the nozzle, which thus acts as an air amplifier to supply both the primary airflow and the entrained air to the user. The entrained air will be referred to herein as a secondary airflow. This secondary airflow is drawn from the room space, region or external environment surrounding the nozzle. The primary airflow therefore combines with the entrained secondary airflow to form a combined, or amplified, airflow projected forward from the front of the nozzle. In contrast, any portion of the primary airflow that is emitted from the second air outlet does not entrain any significant secondary airflow and is therefore referred to herein as a non-amplified airflow.

Preferably, the fan assembly comprises at least one purifying assembly that is arranged to purify the airflow before the airflow is emitted from the fan assembly by any of the first air outlet and the second air outlet.

The nozzle preferably comprises a loop. The nozzle may have any of an annular and an elongate annular shape. The fan assembly may further comprise a fan body with the nozzle being mounted on and supported by the fan body. The fan body may then further comprise the second air outlet. The second air outlet may then be arranged to direct any portion of the airflow that is emitted from the second air outlet such that the non-amplified airflow divaricates away from the fan body.

Alternatively, the nozzle may comprise the second air outlet. The second air outlet may then be arranged to direct any portion of the airflow that is emitted from the second air outlet such that the non-amplified airflow divaricates away from a central axis of the bore defined by the nozzle. To do so, the second air outlet may be arranged to direct any portion of the airflow that is emitted from the second air outlet substantially perpendicularly away from the central axis of the bore defined by the nozzle. The second air outlet may therefore be arranged such that a duct of the second air outlet is substantially perpendicular relative to the central axis of the bore defined by the nozzle.

The second air outlet may extend around at least a portion of an external surface of the nozzle that faces in a direction that is substantially perpendicular to a central axis of the bore defined by the nozzle.

The first air outlet may be arranged to direct the emitted the airflow substantially parallel to a central axis of the bore defined by the nozzle. The first air outlet may be arranged such that a duct of the first air outlet is substantially parallel to a central axis of the bore defined by the nozzle. Preferably, the first air outlet is provided in an edge of the nozzle that faces in a direction that is substantially parallel to a central axis of the bore defined by the nozzle.

Preferably, the fan assembly further comprises a valve that is arranged to direct the airflow to one or both of the first air outlet and the second air outlet in dependence upon the position of a valve member of the valve. The valve member may be arranged to be moveable between a first end position in which the valve member directs the airflow to the first air outlet and occludes the airflow from reaching the second air outlet, and a second end position in which the valve member directs the airflow to the second air outlet and occludes the airflow from reaching the first air outlet. Preferably, the valve member is arranged such that, when located in-between the first end position and the second end position, the valve member directs a first portion of the airflow to the first air outlet and a second portion of the airflow to the second air outlet.

The nozzle may comprise the first air outlet, the second air outlet and an interior passage for conveying the airflow to both the first air outlet and the second air outlet, with the valve then being provided within the interior passage of the nozzle. The shape of one or both of the first air outlet and the second air outlet may then correspond to that of an aligned portion of the interior passage, and the valve may then extend around at least a portion of the interior passage of the nozzle. The valve member may then be arranged such that, in the first end position, the valve member occludes the second air outlet from the airflow within the interior passage and, in the second end position, occludes the first air outlet from the airflow within the interior passage.

The interior passage may be provided with a first airflow channel and a second airflow channel, the first airflow channel being arranged to direct the airflow towards the first air outlet and the second airflow channel being arranged to direct the airflow towards the second air outlet. The valve member may then be arranged such that, in the first end position, the valve member occludes the second airflow channel from the remainder of the interior passage and, in the second end position, occludes the first airflow channel from the remainder of the interior passage.

Preferably, a baffle is provided within the interior passage, the baffle at least partially defining at least one of the first airflow channel and the second airflow channel within the interior passage. The valve member may then be arranged to abut against the baffle in one of the first end position and the second end position to thereby occlude either the first airflow channel or the second airflow channel from the remainder of the interior passage.

The valve may further comprise a valve driver arranged to cause movement of the valve member to direct the airflow to one or both of the first air outlet and the second air outlet. The valve driver may comprise any of a valve motor and a manually driven dial or switch.

The valve driver may be arranged to cause movement of a rack, the rack being provided with a linkage to the valve member so that movement of the rack causes movement of the valve member. The linkage between the rack and the valve member is preferably provided by a cam-follower pair, a cam being provided on one of the rack and the valve member and a follower being provided on the other of the rack and the valve member and arranged to cooperate with the cam.

The valve driver may be arranged to cause movement of a valve actuator, the valve actuator being provided with a linkage to a valve member so that movement of the valve actuator causes movement of the valve member. The linkage between the valve actuator and the valve member is preferably provided by a cam-follower pair, a cam being provided on one of the valve actuator and the valve member and a follower being provided on the other of the valve actuator and the valve member and arranged to cooperate with the cam. The valve driver may be arranged to cause movement of a rack, the rack being connected to the valve actuator so that movement of the rack causes movement of the valve actuator.

The rack may have an arc shape that substantially corresponds to that of an aligned portion of the interior passage and the valve driver may then be arranged to cause circular motion of the rack. A first valve actuator may then be connected to a first end of the arc-shaped rack and a second valve actuator connected to a second end of the arc-shaped rack. A cam of a cam-follower pair linking the first valve actuator to a first valve member may then have an opposing orientation to a cam of a cam-follower pair linking the second valve actuator to a second valve member.

The nozzle may comprise more than one first air outlet and the valve may then comprise a valve member corresponding to each of the more than one first air outlets, each valve member being arranged to direct the airflow to a corresponding first air outlet in dependence upon the position of the valve member. Alternatively or in addition, the nozzle may comprise more than one second air outlet and the valve may then comprise a valve member corresponding to each of the more than one second air outlets, each valve member being arranged to direct the airflow to a corresponding second air outlet in dependence upon the position of the valve member. Each of the more than one valve members may then be arranged to be moveable between a first end position in which the valve member directs the airflow to a first air outlet and occludes the airflow from reaching a second air outlet, and a second end position in which the valve member directs the airflow to a second air outlet and occludes the airflow from reaching a first air outlet.

According a second aspect there is provided a nozzle for a fan assembly, the nozzle comprising an air inlet for receiving an airflow from the fan assembly, a first air outlet and a second air outlet. The nozzle defines a bore through which air from outside the fan assembly is drawn by any portion of the airflow that is emitted from the first outlet and which then combines with the airflow emitted from the first air outlet to produce an amplified airflow. The second air outlet is arranged such that any portion of the airflow that is emitted from the second air outlet does not draw air through the bore defined by the nozzle thereby producing a non-amplified airflow.

Preferably, the nozzle further comprises a valve that is arranged to direct the airflow to one or both of the first air outlet and the second air outlet in dependence upon the position of a valve member of the valve. The valve member may be arranged to be moveable between a first end position in which the valve member directs the airflow to the first air outlet and occludes the airflow from reaching the second air outlet, and a second end position in which the valve member directs the airflow to the second air outlet and occludes the airflow from reaching the first air outlet. The valve member may be arranged such that, when located in-between the first end position and the second end position, the valve member directs a first portion of the airflow to the first air outlet and a second portion of the airflow to the second air outlet.

The second air outlet may be arranged to direct any portion of the airflow that is emitted from the second air outlet substantially perpendicularly away from the central axis of the bore defined by the nozzle. The second air outlet may therefore be arranged such that a duct of the second air outlet is substantially perpendicular relative to the central axis of the bore defined by the nozzle. The second air outlet may extend around at least a portion of an external surface of the nozzle that faces in a direction that is substantially perpendicular to a central axis of the bore defined by the nozzle.

The first air outlet may be arranged to direct the emitted the airflow substantially parallel to a central axis of the bore defined by the nozzle. The first air outlet may be arranged such that a duct of the first air outlet is substantially parallel to a central axis of the bore defined by the nozzle. Preferably, the first air outlet is provided in an edge of the nozzle that faces in a direction that is substantially parallel to a central axis of the bore defined by the nozzle.

The nozzle may comprise an interior passage for conveying air from the air inlet to the first air outlet and second air outlet. The valve may then be provided within the interior passage of the nozzle.

According a third aspect there is provided a fan assembly comprising an impeller, a motor for rotating the impeller to generate an airflow, and a nozzle according to the second aspect and arranged to receive the airflow generated by the impeller.

BRIEF DESCRIPTION OF THE DRAWINGS

An embodiment of the present invention will now be described, by way of example only, with reference to the accompanying drawings, in which.

DETAILED DESCRIPTION OF THE INVENTION

Figure 1A:
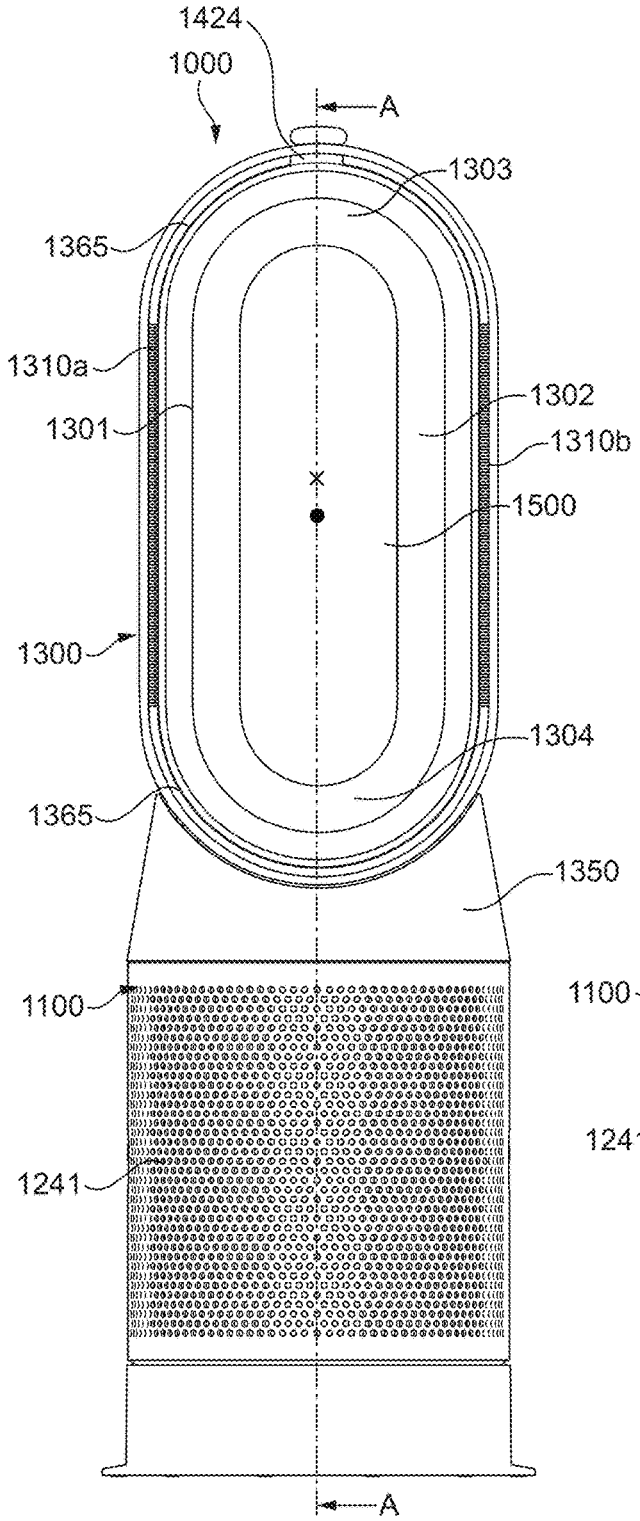
FIG. 1*a* is a front view of a first embodiment of a fan assembly.

There will now be described a fan assembly that can deliver either an amplified airflow or a non-amplified airflow or simultaneously deliver both an amplified airflow and a non-amplified airflow, and in doing so provide the user of the fan assembly with various options as to how air is delivered by the fan assembly. The term "fan assembly" as used herein refers to a fan assembly configured to generate and deliver an airflow for the purposes of thermal comfort and/or environmental or climate control. Such a fan assembly may be capable of generating one or more of a dehumidified airflow, a humidified airflow, a purified airflow, a filtered airflow, a cooled airflow, and a heated airflow.

The fan assembly 1000 comprises a body or stand 1100 comprising an air inlet 1110 through which a primary airflow enters the body 1100, at least one removable purifying/filter assembly 1200 mounted on the body 1100 over the air inlet 1110, and a nozzle 1300 mounted on an air vent/opening 1115 through which the primary airflow exits the body 1100. The nozzle 1300 comprises a first air outlet 1310 for emitting the primary airflow from the fan assembly 1000, a second air outlet 1320 for emitting the primary airflow from the fan assembly 1000, and a valve 1400 that is arranged to direct the primary airflow to one or both of the first air outlet 1310 and the second air outlet 1320 in dependence upon the position of a valve member 1410 of the valve 1400.

The nozzle 1300 comprises an interior passage 1330 for conveying air from an air inlet 1340 of the nozzle 1300 to one or both of the first air outlet 1310 and the second air outlet 1320. The nozzle 1300 also defines a central/inner opening/bore 1500 through which air from outside the fan assembly 1000 is drawn by the primary airflow emitted from the first outlet 1310 and which combines with the emitted airflow to produce an amplified airflow. The nozzle 1300 therefore forms a loop that extends around and surrounds the bore 1500.

The second air outlet 1320 of the nozzle 1300 is arranged to receive the airflow from the interior passage 1330 and to emit the airflow without drawing air from outside the fan assembly through the opening/bore 1500 defined by the nozzle 1300, thereby producing a non-amplified airflow. In the embodiments illustrated herein, the second air outlet 1320 is arranged to direct the emitted the airflow such that it substantially radiates/divaricates away from the fan assembly 1000. In particular, the second air outlet 1320 is arranged to direct the non-amplified airflow such that it substantially radiates/divaricates away from a central axis (X) of the opening/bore 1500 defined by the nozzle 1300, i.e. at an angle of between 30 degrees and 150 degrees away from the central axis (X) of the opening/bore 1500 defined by the nozzle 1300. Preferably, the second air outlet 1320 is arranged to direct the non-amplified airflow substantially perpendicularly away from the central axis (X) of the opening/bore 1500 defined by the nozzle 1300, i.e. at an angle from 45 to 135 degrees away from the central axis (X) of the opening/bore 1500 defined by the nozzle 1300, and more preferably at an angle from 70 to 110 degrees from the central axis (X) of the opening/bore 1500 defined by the nozzle 1300. The second air outlet 1320 would therefore be arranged to direct the non-amplified airflow in a direction that is substantially perpendicular to the direction in which air is drawn through the bore 1500.

Figure 1B:
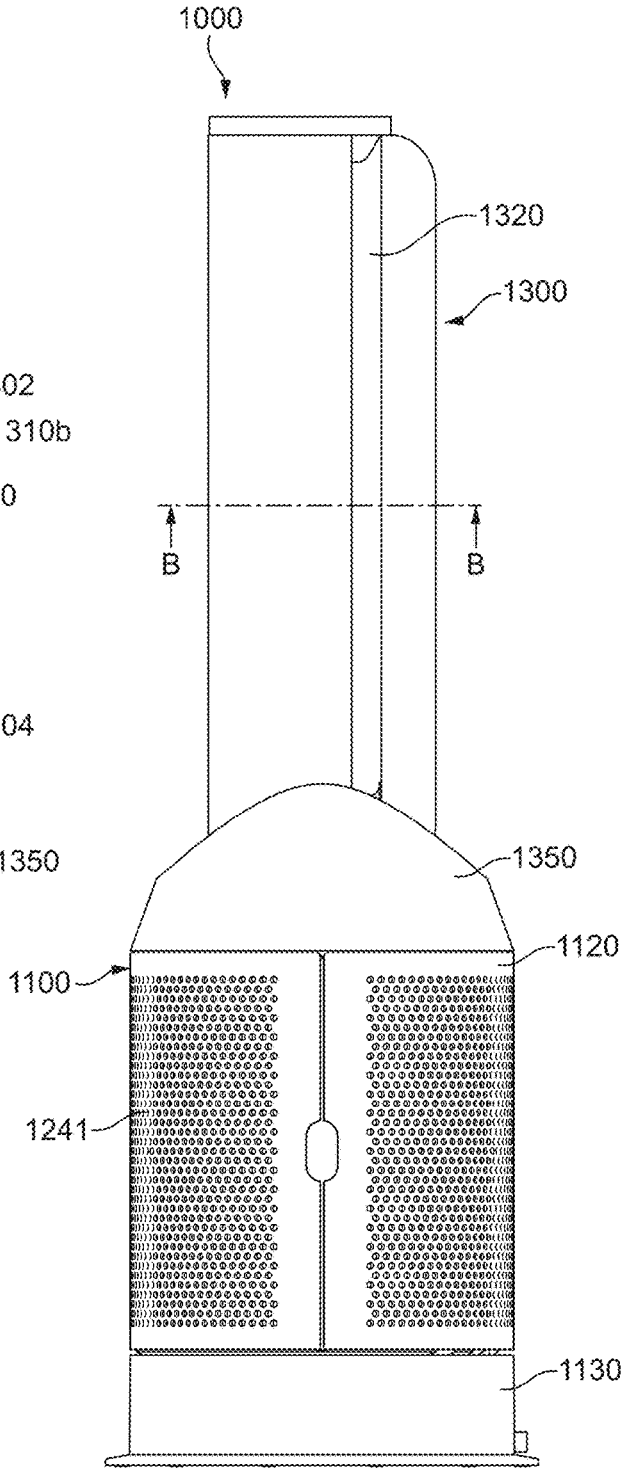
FIG. 1*b* is a right side view of the first embodiment of the fan assembly.
Figure 2:
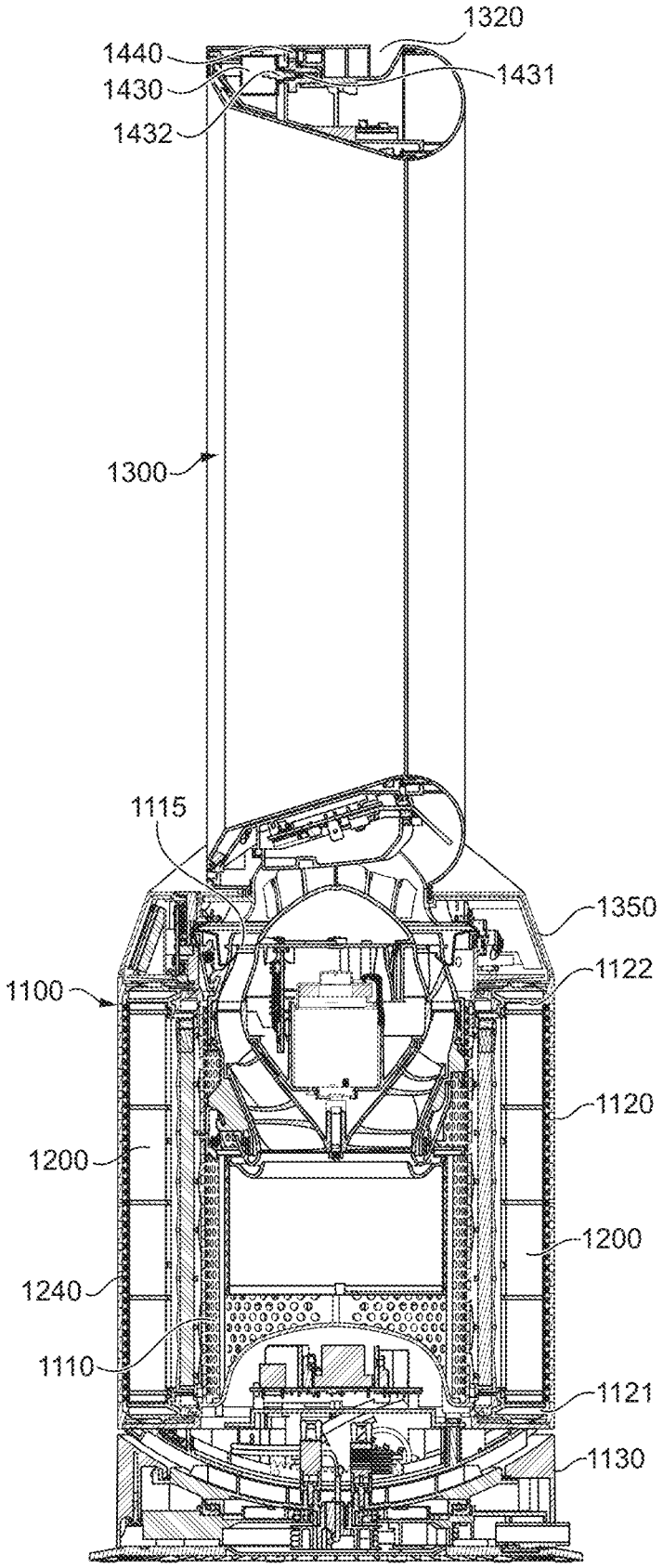
FIG. 2 is a right side cross-section view, taken along line A-A in FIG. 1*a;*
Figure 3:
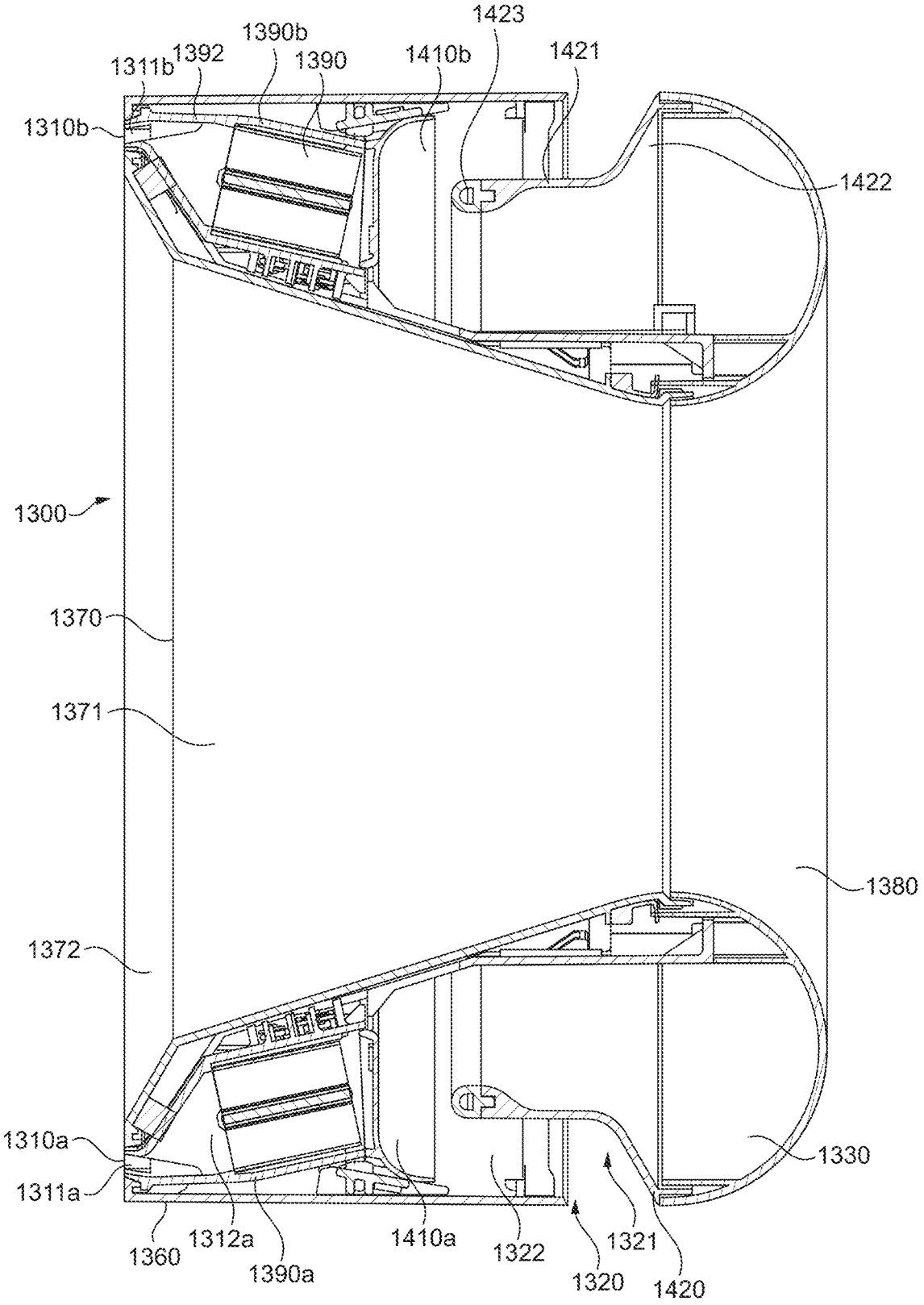
FIG. 3 is a cross-sectional view through the nozzle of the fan assembly, taken along line B-B in FIG. 1*b;*
Figure 4:
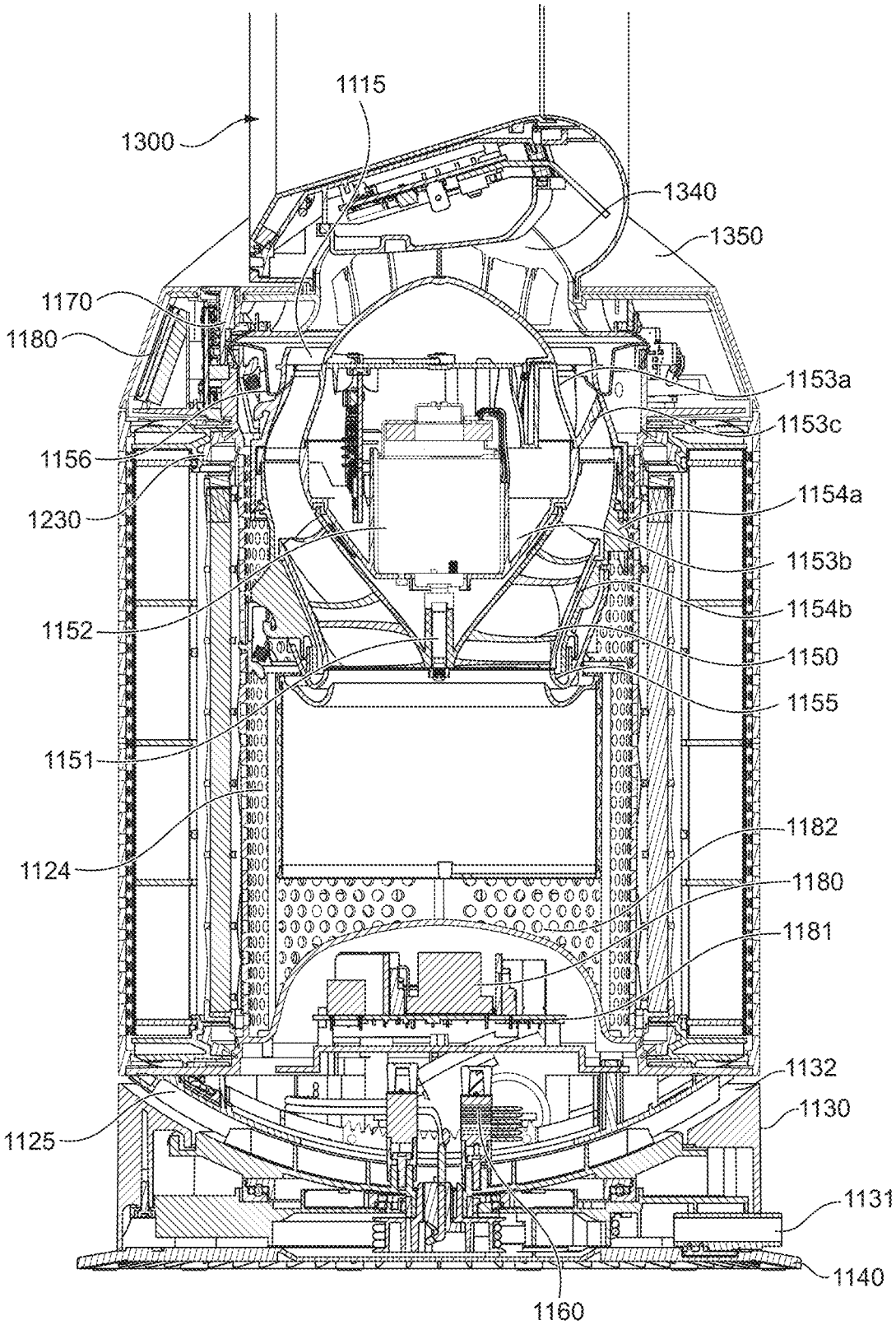
FIG. 4 then shows an enlarged view of a portion of the cross-section view of FIG. 2.

FIGS. 1*a* and 1*b* are external views of a first embodiment of a free-standing environmental control fan assembly 1000, and FIGS. 2 and 3 show sectional views through lines A-A and B-B of FIGS. 1*a* and 1*b* respectively. FIG. 4 then shows an enlarged sectional view of the body 1100 of the fan assembly 1000 illustrated in FIGS. 1*a* and 1*b*.

As shown in FIGS. 2 and 4, the body 1100 comprises a substantially cylindrical main body section 1120 mounted on a substantially cylindrical lower body section 1130. The main body section 1120 has a smaller external diameter than the lower body section 1130. The main body section 1120 has a lower annular flange 1121 that extends radially/perpendicularly away from the lower end of the main body section 1120. The outer edge of the lower annular flange 1121 is substantially flush with the external surface of the lower body section 1130. The removable purifying/filter assemblies 1200 are then mounted on the main body section 1120, resting on the lower annular flange 1121 of the main body section 1120. In this embodiment, the main body section 1120 further comprises an upper annular flange 1122 that extends radially/perpendicularly away from an opposite, upper end of the main body section 1120. The outer edge of the upper annular flange 1122 is then substantially flush with the external surface of a base/neck 1350 of the nozzle 1300 that connects to upper end of the main body section 1120.

Figure 5:
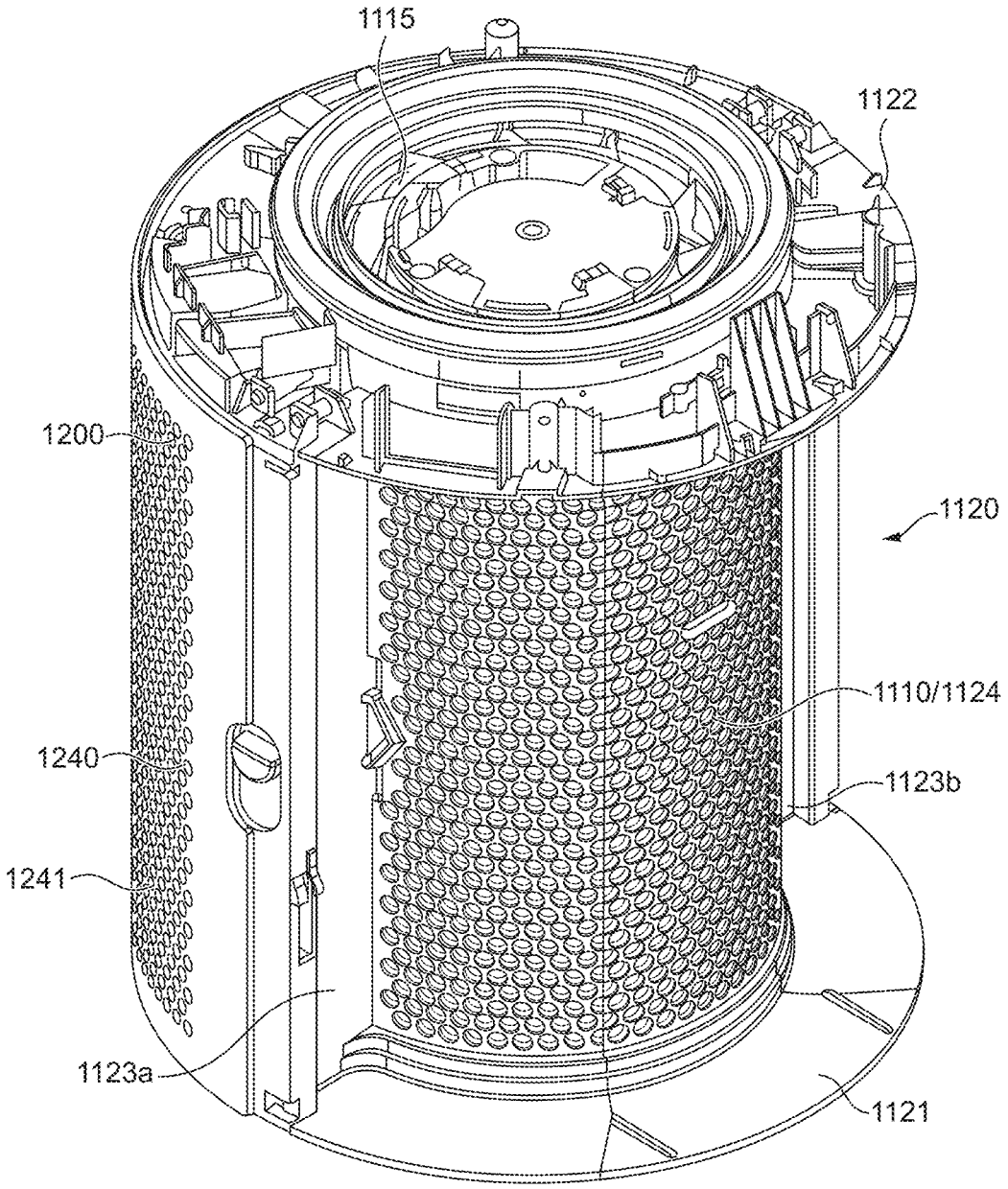
FIG. 5 is a perspective view of a main body section of the fan assembly of FIGS. 1*a* and 1*b;*

In this first embodiment, the fan assembly 1000 comprises two separate purifying assemblies 1200*a*, 1200*b* that are configured to be located on and cover two opposing halves of the main body section 1120. Each purifying assembly 1200 therefore substantially has the shape of a half cylinder/tube that can therefore be located concentrically over the main body section 1120, resting on the lower annular flange 1121 of the main body section 1120. Accordingly, FIG. 5 shows the main body section 1120 with one of the purifying assemblies 1200*a* removed and with the other of the purifying assemblies 1200*b* mounted on the far side of the main body section 1120.

Figure 6A:
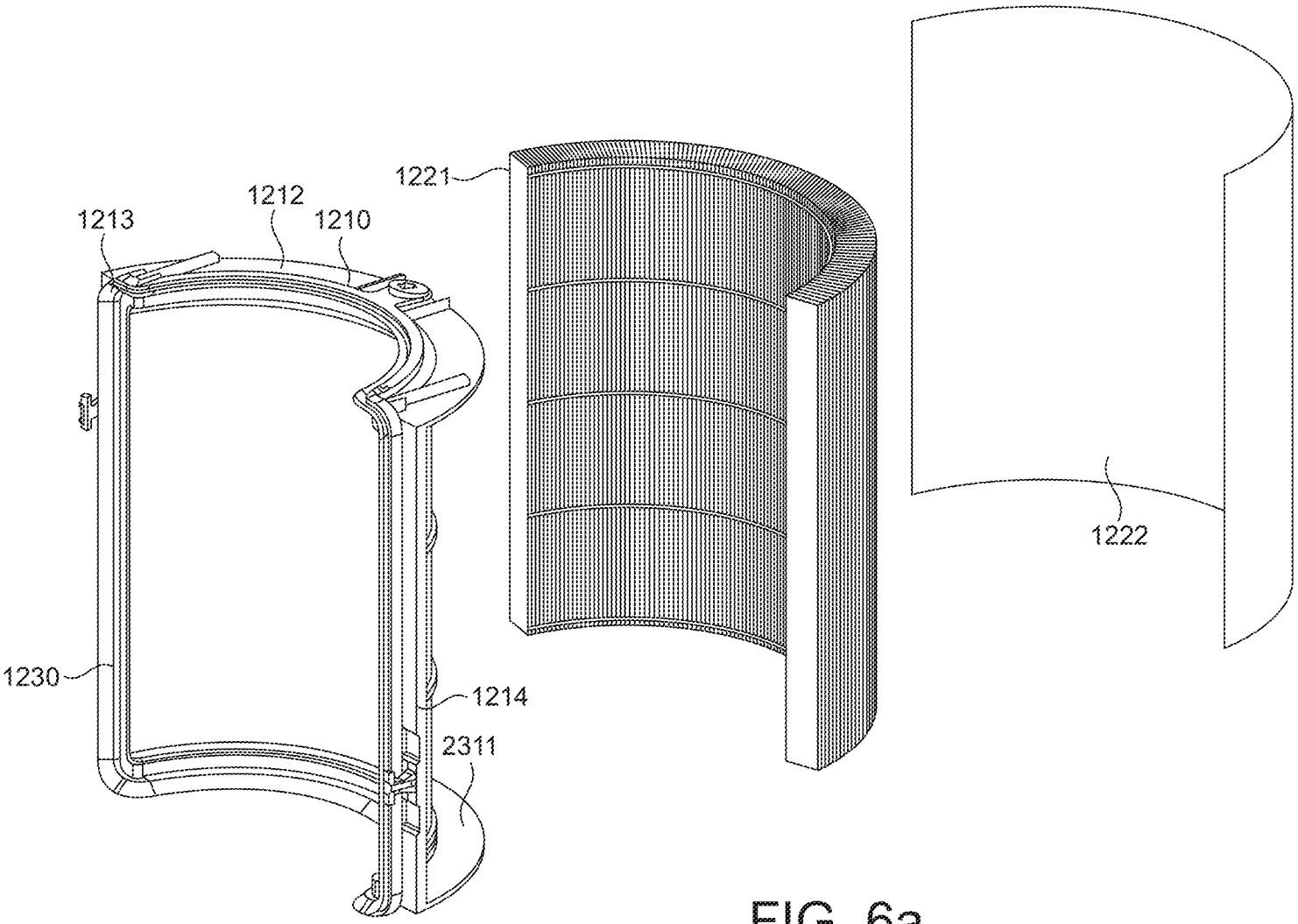
FIG. 6*a* is an exploded view of the purifying assembly of the fan assembly of FIGS. 1*a* and 1*b;*

FIG. 6*a* illustrates an exploded view of an embodiment of a filter assembly 1200 suitable for use with the fan assembly of FIGS. 1 to 5. In this embodiment, each filter assembly 1200 comprises a filter frame 13210 that supports one or more filter media. Each filter frame 1210 substantially has the shape of a semi-cylinder with two straight sides that are parallel to the longitudinal axis of the filter frame 1210 and two curved ends that are perpendicular to the longitudinal axis of the filter frame 1210. The one or more filter media are arranged so as to cover the surface area defined by the filter frame 1210.

The filter frame 1210 is provided with a first end flange 1211 that extends radially/perpendicularly away from a first curved end of the filter frame 1210 and a second end flange 1212 that extends radially/perpendicularly away from an opposite, second curved end of the filter frame 1210. Each filter frame 1210 is then also provided with a first side flange 1213 that extends perpendicularly away from a first side of the filter frame 1210, from a first end of the first end flange 1211 to a first end of the second end flange 1212, and a second side flange 1214 that extends perpendicularly away from a second side of the filter frame 1210, from a second end of the first end flange 1211 to a second end of the second end flange 1212. The first end flange 1211, second end flange 1212, first side flange 1213 and second side flange 1214 are integrally formed with one another to thereby form a ridge or rim that extends around the entire periphery of the filter frame 1210. The flanges 1211-1214 provide surfaces to which the filter media can be sealed (e.g. using glue on the downstream side of filter assembly 1210) and also provide surfaces that allow the filter frame 1210 to form a seal with the main body 1120 of the fan assembly 1000 (e.g. with corresponding flanges on the main body section 1120) to prevent air from leaking into or out of the fan body 1100 without passing through the filter media.

Each filter assembly 1200 further comprises a flexible seal 1230 provided around the entirety of an inner periphery of the filter frame 1210 for engaging with the main body section 1120 to prevent air from passing around the edges of the filter assembly 1200 to the air inlet 1110 of the main body section 1120. The flexible filter seal 1230 preferably comprises lower and upper curved seal sections that substantially take the form of an arc-shaped wiper or lip seal, with the each end of the lower seal section being connected to a corresponding end of the upper seal section by two straight seal sections that each substantially take the form of a wiper or lip seal. The upper and lower curved seal sections are therefore arranged to contact the curved upper and lower ends of the main body section 1120, whilst the straight seal sections are arranged to contact one or other of two diametrically opposed, longitudinal flanges extend perpendicularly away from the main body section 1120. Preferably, the filter frame 1210 is provided with a recess (not shown) that extends around the entirety of the inner periphery of the filter frame 1210 and that is arranged to receive and support the seal 1230. In the illustrated embodiment, this recess extends across an inner surface of both the first side flange 1213 and second side flange 1214, and across an inner edge of both the first end and the second end of the filter frame 1210.

One or more filter media 1221, 1222 are then supported on the outer, convex face of the filter frame 1210, extending across the area between the first and second flanges 1211, 1212 and the first second side flanges 1213, 1214. In the illustrated embodiment, each filter assembly 1200*a*, 1200*b* comprises a particulate filter media layer 1221 covered with an outer mesh layer 1222 attached on the outer face of the filter frame 1210. Optionally, one or more further filter media can then be located within the inner, concave face of the filter frame 1210. For example, these further filter media could comprise a first chemical filter media layer covered by a second chemical filter media layer that are both located within the inner face of the filter frame 1210. These further filter media could either be attached to and/or support on the inner, concave face of the filter frame 1210 or alternatively could be mounted on to the main body section 1120, resting on the lower annular flange 1111 of the main body section 1120 beneath each filter assembly 1200*a*, 1200*b*. In either case, the filter frame 1210 will be formed so that it defines a space within the inner, concave face of the filter frame

1210 within which these further filter media can be accommodated when the filter assembly 1200 is mounted onto the main body section 1120.

Figure 6B:
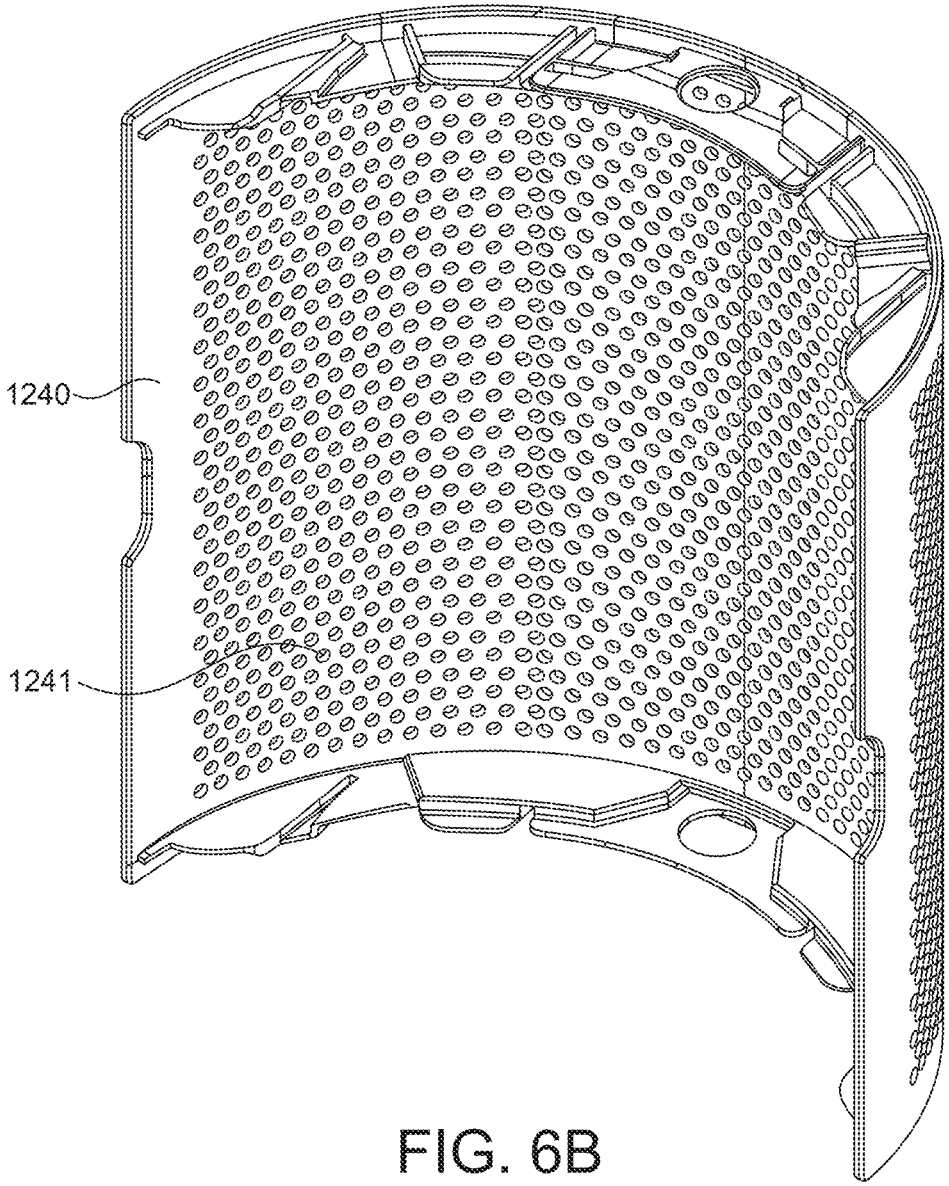
FIG. 6*b* is a rear perspective view of a perforated shroud suitable for use with the fan assembly FIGS. 1*a* and 1*b;*
Figure 7:
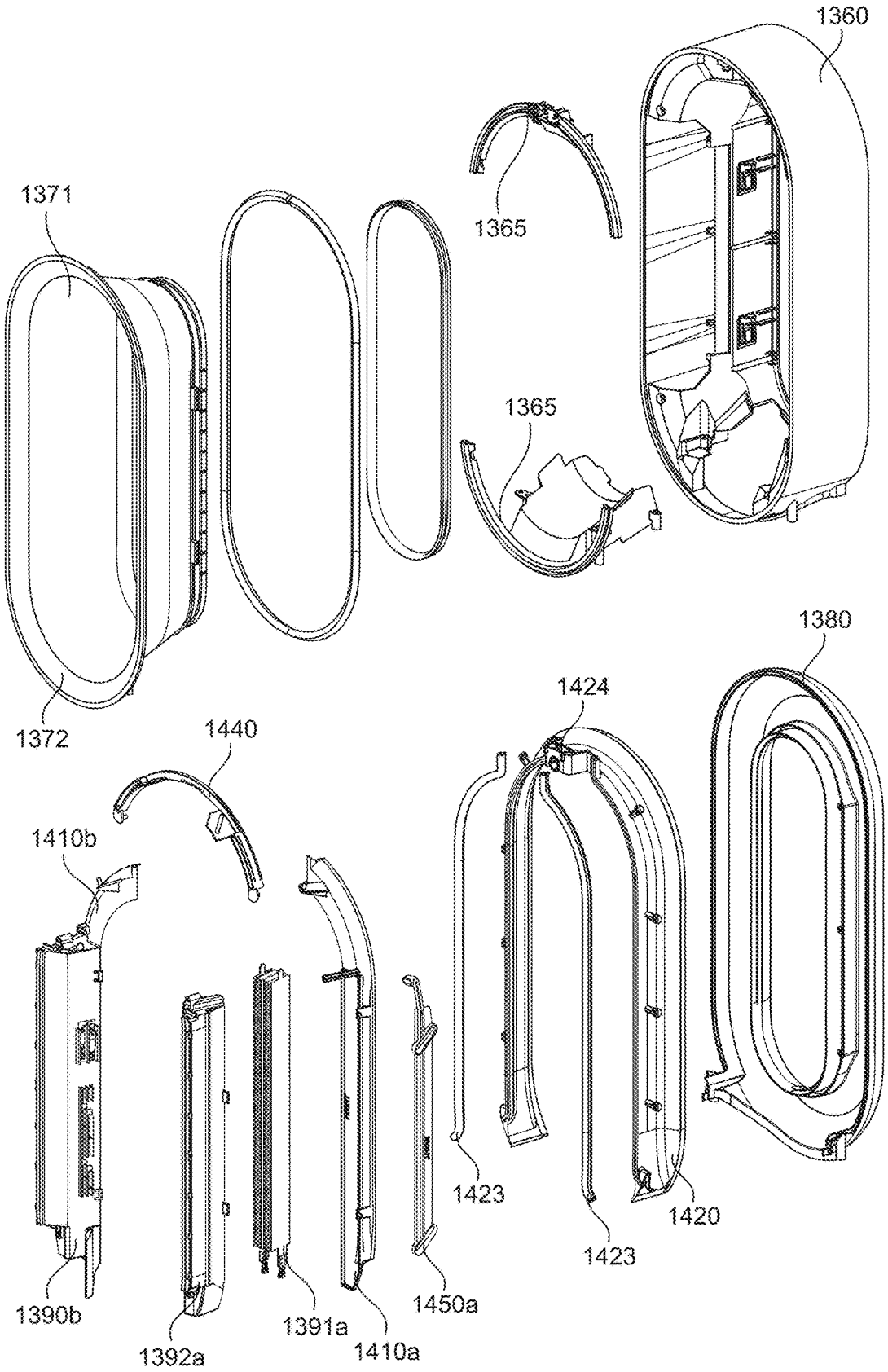
FIG. 7 is an exploded view of the nozzle of the fan assembly of FIGS. 1*a* and 1*b;*

As shown in FIG. 5, a perforated shroud 1240 that is substantially in the shape of a half cylinder is then attached concentrically to the filter frame 1210 so as to cover the purifying assemblies 1200 when located on the main body section 1120. FIG. 6*b* illustrates a rear perspective view of a perforated shroud 1240 suitable for use with the fan assembly of FIGS. 1 to 5. The perforated shrouds 1240 each comprise an array of apertures which act as an air inlet 1241 of the purifying assembly 1200 in use of the fan 1000. Alternatively, the air inlet 1241 of the shroud 1240 may comprise one or more grilles or meshes mounted within windows in the shroud 1240. It will also be clear that alternative patterns of air inlet arrays are envisaged within the scope of the present invention. The shrouds 1240 protect the filter media 1221-1224 from damage, for example during transit, and also provides a visually appealing outer surface for the purifying assemblies 1200, which is in keeping with the overall appearance of the fan assembly 1000. As the shroud 1240 defines the air inlet 1241 for the purifying assembly 1200, the array of apertures are sized to prevent larger particles from entering the purifying assembly 1200 and blocking, or otherwise damaging, the filter media 1221-1224.

The main body section 1120 comprises a perforated housing 1124 that contains various components of the fan assembly 1000. The perforated housing 1124 comprises the array of apertures which act as the air inlet 1110 of the body 1100 of the fan assembly 1000. The purifying assemblies 1200 are then located upstream from the air inlets 1110 of the main body section 1120, such that the air drawn into the main body section 1120 by the impeller 1150 is filtered prior to entering the main body section 1120. This serves to remove any particles which could potentially cause damage to the fan assembly 1000, and also ensures that the air emitted from the nozzle 1300 is free from particulates. In addition, this also serves to remove various chemical substances from that could potentially be a health hazard so that the air emitted from the nozzle 1300 is purified. In this embodiment the air inlets 1110 comprise an array of apertures formed in the main body section 1120. Alternatively, the air inlets 1110 could comprise one or more grilles or meshes mounted within windows formed in the main body section 1120. The main body section 1120 is open at the upper end thereof to accommodate the air vent/opening 1115 through which the primary airflow is exhausted from the body 1100.

The lower body section 1130 comprises a further housing containing components of the fan assembly 1000 other than those contained within main body section 1120. The lower body section 1130 is mounted on a base 1140 for engaging a surface on which the fan assembly 1000 is located. Specifically, the base 1140 supports the fan assembly 1000 when located on a surface with the nozzle 1300 uppermost relative to the base 1140. In this embodiment, the lower body section 1130 houses a pan drive gear (not shown) that is engaged by a pan pinion (not shown). The pan pinion is driven by an oscillation motor 1160 housed within the bottom of the main body section 1120. Rotation of the pan pinion by the oscillation motor 1160 therefore causes the main body section 1120 to rotate relative to the lower body section 1130. A mains power cable (not shown) for supplying electrical power to the fan assembly 1000 extends through an aperture 1131 formed in the lower body section 1130. The external end of the cable is then connected to a plug for connection to a mains power supply.

The main body section 1120 may be tilted relative to the lower body section 1130 to adjust the direction in which the primary airflow is emitted from the fan assembly 1000. For example, the upper surface 1132 of the lower body section 1130 and the lower surface 1125 of the main body section 1120 may be provided with interconnecting features which allow the main body section 1120 to move relative to the lower body section 111 while preventing the main body section 110 from being lifted from the lower body section 1130. For example, the lower body section 1130 and the main body section 1120 may comprise interlocking L-shaped members. In this embodiment, the upper surface 1132 of the lower body section 1130 is concave and the lower surface 1125 of the main body section 1120 is correspondingly convex. At least a portion of the two surfaces will therefore remain adjacent to one another, and the interconnecting features will remain at least partially connected, when the main body section 1120 is tilted relative to the lower body section 1130.

As described above, the main body section 1120 houses the oscillation motor 1160 that drives the pan pinion that is engaged with the pan drive gear within the lower body section 1130. In the embodiment illustrated in FIGS. 3 and 5, the oscillation motor 1160 is housed within the bottom of the main body section 1120, adjacent to the convex lower surface 1125 of the main body section 1120. Together the oscillation motor 126, the pan pinion and the pan drive gear provide an oscillation mechanism for oscillating the main body section 1120 relative to the lower body section 1130. This oscillation mechanism is controlled by a main control circuit 1170 of the fan assembly 1000 in response to control inputs provided by a user.

The mains power cable passes through the lower body section 1130 with the internal end of the mains power cable then being connected to a power supply unit 1180 housed towards the bottom of the main body section 1120. In this embodiment, the power supply unit 1180 is mounted on a power supply mount 1181 that is fixed above the oscillation motor 1160. A power supply cover 1182 is then positioned over the power supply unit 1180 to enclose and protect the power supply unit 1180. In this embodiment, the power supply cover 1182 is substantially dome-shaped to minimize any disturbance of the primary airflow that enters the fan assembly 1000 through the air inlet 1110 and to assist in guiding primary airflow. Optionally, a heat sink (not shown) can be provided on the upper surface of the power supply cover 1182 to assist in dissipating heat generated by the power supply unit 1180. Mounting the heat sink on the upper surface of the power supply cover 1182 locates the heat sink within the path of the primary airflow that enters the body 1100 through the air inlet 1110 such that the primary airflow will further assist in dissipating heat generated by the power supply unit 1180.

The main body section 1120 houses the impeller 1150 for drawing the primary airflow through the air inlet 1110 and into the body 1100. Preferably, the impeller 1150 is in the form of a mixed flow impeller. The impeller 1150 is connected to a rotary shaft 1151 extending outwardly from a motor 1152. In the embodiment illustrated in FIGS. 3 and 5, the motor 1152 is a DC brushless motor having a speed which is variable by the main control circuit 1170 in response to control inputs provided by a user. The motor 1152 is housed within a motor bucket 1153 that comprises an upper portion 1153*a* connected to a lower portion 1153*b*.

The upper portion 1153*a* of the motor bucket further comprises a diffuser 1153*c* in the form of an annular disc having curved blades.

The motor bucket 1153 is located within, and mounted on, an impeller housing 1154 that is mounted within the main body section 1120. The impeller housing 1154 comprises a generally frusto-conical impeller wall 1154*a* and an impeller shroud 1154*b* located within the impeller wall 1154*a*. The impeller 1150, impeller wall 1154*a* and an impeller shroud 1154*b* are shaped so that the impeller 1150 is in close proximity to, but does not contact, the inner surface of the impeller shroud 1154*b*. A substantially annular inlet member 1155 is then connected to the bottom of the impeller housing 1154 for guiding the primary airflow into the impeller housing 1154.

In the embodiment illustrated in FIGS. 2 and 4, the air vent/opening 1115 through which the primary airflow is exhausted from the body 1100 is defined by the upper portion of the motor bucket 1153*a* and the impeller wall 1154*a*.

A flexible sealing member 1156 is attached between the impeller housing 1154 and the main body section 1120. The flexible sealing member 1156 prevents air from passing around the outer surface of the impeller housing 1154 to the inlet member 1155. The sealing member 1156 preferably comprises an annular lip seal, preferably formed from rubber.

As described above, the nozzle 1300 is mounted on the upper end of the main body section 1120 over the air vent 1115 through which the primary airflow exits the body 1100. The nozzle 1300 comprises a neck/base 1350 that connects to upper end of the main body section 1120, and has an open lower end which provides an air inlet 1340 for receiving the primary airflow from the body 1100. The external surface of the base 1350 of the nozzle 1300 is then substantially flush with the outer edge of the upper annular flange 1121 of the main body section 1120. The base 1350 therefore comprises a housing that covers/encloses any components of the fan assembly 1000 that are provided on the upper surface 1121 of the main body section 1120.

In the embodiment illustrated in FIGS. 3 and 5, the main control circuit 1170 is mounted on the upper surface of the upper annular flange 1121 that extends radially away from the upper end of the main body section 1120. The main control circuit 1170 is therefore housed within base 1350 of the nozzle 1300. In addition, an electronic display 1180 is also mounted on the upper annular flange 1121 of the main body section 1120 and therefore housed within base 1350 of the nozzle 1300, with the display 1180 being visible through an opening or at least partially transparent window provided in the base 1350. Optionally, one or more additional electronic components may be mounted on the upper surface of the upper annular flange 1121 and consequentially housed within base 1350 of the nozzle 1300. For example, these additional electronic components may one or more wireless communication modules, such as Wi-Fi, Bluetooth etc., and one or more sensors, such as an infrared sensor, a dust sensor etc., and any associated electronics. Any such additional electronic components would then also be connected to the main control circuit 1170.

In the embodiment illustrated in FIGS. 1 to 4, the nozzle 1300 has an elongate annular shape, often referred to as a stadium shape, and defines an elongate opening 1500 having a height greater than its width. The nozzle 1300 therefore comprises two relatively straight sections 1301, 1302 each adjacent a respective elongate side of the opening 1500, an upper curved section 1303 joining the upper ends of the straight sections 1301, 1302, and a lower curved section 1304 joining the lower ends of the straight sections 1301, 1302.

The nozzle 1300 therefore comprises an elongate annular outer casing section 1360 that is concentric with and extends about an elongate annular inner casing section 1370. In this example, the inner casing section 1360 and the outer casing section 1370 are separate components; however, they could also be integrally formed as a single piece. The nozzle 1300 also has a curved rear casing section 1380 that forms the rear of the nozzle 1300, with an inner end of the curved rear casing section 1380 being connected to a rear end of the inner casing section 1370. In this example, the inner casing section 1370 and the curved rear casing section 1380 are separate components that are connected together, for example, using screws and/or adhesives; however, they could also be integrally formed as a single piece. The curved rear casing section 1380 has a generally elongate annular cross-section perpendicular to the central axis (X) of the inner bore 1500 of the nozzle 1300, and a generally semi-circular cross-section parallel to the central axis (X) of the inner bore 1500 of the nozzle 1300.

The inner casing section 1370 has a generally elongate annular cross-section perpendicular to the central axis (X) of the inner bore 1500 of the nozzle 1300, and extends around and surrounds the inner bore 1500 of the nozzle 1300. In this example, the inner casing section 1370 has a rear portion 1371 and a front portion 1372. The rear portion 1371 is angled outwardly from the rear end of the inner casing section 1372 away from the central axis (X) of the inner bore 1500. The front portion 1372 is also angled outwardly from the rear end of the inner casing section 1370 away from the central axis (X) of the inner bore 1500, but with a greater angle of inclination than that of the rear portion 1371. The front portion 1372 of the inner casing section 1370 therefore tapers towards the front end of the outer casing section 1360, but does not meet the front end of the outer casing section 1360, with the space between the front end of the inner casing section 1370 and the front end of the outer casing section 1360 defining a slot that forms a first air outlet 1310 of the nozzle 1300.

The outer casing section 1360 then extends from the front of the nozzle 1300 towards an outer end of the curved rear casing section 1380, but does not meet the outer end of the curved rear casing section 1380, with the space between a rear end of the outer casing section 1360 and the outer end of the curved rear casing section 1380 defining a slot that forms a second air outlet 1320 of the nozzle 1300.

The outer casing section 1360, inner casing section 1370 and curved rear casing section 1380 therefore define an interior passage 1330 for conveying air from the air inlet 1340 of the nozzle 1300 to one or both of the first air outlet 1310 and the second air outlet 1320. In other words, the interior passage 1330 is bounded by the internal surfaces of the outer casing section 1360, inner casing section 1370 and curved rear casing section 1380. The interior passage 1330 may be considered to comprise first and second sections which each extend in opposite directions about the bore 1500, as the air that enters the nozzle 1300 through the air inlet 1340 will enter the lower curved section 1304 of the nozzle 1300 and be divided into two air streams which each flow into a respective one of the straight sections 1301, 1302 of the nozzle 1300.

The nozzle 1300 further comprises two curved seal members 1365 each for forming a seal between the outer casing section 1360 and the inner casing section 1370 at the top and bottom curved sections 1303, 1304 of the nozzle 1300, so that there is substantially no leakage of air from the curved sections of the interior passage 1330 of the nozzle 1300. The nozzle 1300 therefore comprises two elongate first air outlets 1310*a*, 1310*b* each located on a respective elongate side of the central bore 1500. In this embodiment, the nozzle 1300 is therefore provided with a pair of first air outlets 1310*a*, 1310*b* for emitting the primary airflow that are located on the opposite elongate sides of the nozzle 1300/opening 1500 towards the front of the nozzle 1300.

The nozzle 1300 then further comprises a pair of heater assemblies 1390*a*, 1390*b* within the interior passage 1330, each heater assembly 1390*a*, 1390*b* being adjacent to a respective one of the pair of first air outlets 1310*a*, 1310*b*. Each heater assembly 1390*a*, 1390*b* comprises a plurality of heater elements 1391 supported within a frame 1392, with the frame 1392 then being mounted within the interior passage 1330 of the nozzle 1300 adjacent to the respective first air outlet 1310*a*, 1310*b*. The frame 1392 of each heater assembly 1390*a*, 1390*b* is therefore arranged, when mounted within the interior passage 1330, to direct the airflow through the heating elements 1391 and out of the corresponding first air outlet 1310*a*, 1310*b*. To do so, the portion of the frame 1392 that is between the heater elements 1391 and the corresponding first air outlet 1310*a*, 1310*b* tapers towards the air outlet, with a narrow end of the frame 1392 being fitted within the corresponding first air outlet 1310*a*, 1310*b* provided in the forward facing edge of the nozzle 1300. This tapered portion of the frame 1392 therefore acts as an airflow guide member as it funnels the primary airflow towards the first air outlet 1310*a*, 1310*b* and forms the duct 1311 of the first air outlet 1310*a*, 1310*b*.

In the embodiment illustrated in FIG. 4, each of first air outlets 1310*a*, 1310*b* is therefore provided with a corresponding first airflow channel 1312*a*, 1312*b* within the interior passage 1330 of the nozzle 1300 that is defined by the frame 1392 of the corresponding heater assembly 1390. The first airflow channels 1312*a*, 1312*b* are each arranged to direct the airflow towards the corresponding first air outlet 1310*a*, 1310*b*. The air inlet into the first airflow channel 1312*a*, 1312*b*, as defined by inner edge of the frame 1392 of the heater assembly 1390, is substantially perpendicular to the central axis (X) of the bore/opening 1500.

In order for the airflow emitted from the pair of first air outlets 1310*a*, 1310*b* to draw air from outside the fan assembly 1000 and combine with this air to produce an amplified airflow, the first air outlets 1310*a*, 1310*b* are arranged to direct the emitted the airflow in a direction that is substantially parallel to the central axis (X) of the opening/bore 1500 defined by the nozzle 1300, i.e. at an angle from −30 to 30 degrees away from the central axis, preferably at an angle from −20 to 20 degrees away from the central axis, and more preferably at an angle from −10 to 10 degrees away from the central axis. To do so, the first air outlets 1310*a*, 1310*b* are arranged such that a duct 1311 of each first air outlet 1310*a*, 1310*b* is substantially parallel to the central axis (X) of the opening/bore 1500 defined by the nozzle 1300.

The second air outlet 1320 is then arranged such that a duct 1321 of the second air outlet 1320 is substantially perpendicular relative to the central axis (X) of the opening/bore 1500 defined by the nozzle 1300. As a consequence, the non-amplified airflow emitted from the second air outlet 1320 will be directed substantially perpendicularly away from the central axis (X) of the opening/bore 1500 defined by the nozzle 1300. As illustrated in FIG. 4, the duct 1321 of the second air outlet 1320 extends from the interior passage 1330 that carries the primary airflow received from the body 1100 to the external periphery of the nozzle 1300 in a direction that is substantially perpendicular to the direction of the air drawn through the bore 1500.

In the embodiment illustrated in FIG. 4, a baffle 1420 is provided within the interior passage that defines a second airflow channel 1322 within the interior passage 1330 that is arranged to direct the primary airflow towards the second air outlet 1320. The baffle 1420 extends into the interior passage 1330 from an interior surface of the nozzle 1300 that at least partially defines the interior passage 1330, with the second airflow channel 1322 being a section of the interior passage 1330 that is on one side of the baffle 1420. In particular, the second airflow channel 1322 comprises a section of the interior passage 1330 that is bounded by the baffle 1420 and by a portion of the interior surface of the nozzle 1300 that is adjacent to the second air outlet 1320.

The baffle 1420 is provided by a baffle wall that extends into the interior passage 1330 from the curved rear casing section 1380. The baffle wall 1420 is connected to the outer end of the curved rear casing section 1380 and has a front portion 1421 and a rear portion 1422. The rear portion 1422 of the baffle wall 1420 is angled inwardly from the outer end of the curved rear casing section 1380 towards the central axis (X) of the bore 1500. The front portion 1421 is then angled relative to the rear portion 1422 so that the front portion 1421 is parallel to the outer casing section 1360, with the majority of the front portion 1421 overlapping the outer casing section 1360. The portion of the interior passage 1330 that is located between the front portion 1421 of the baffle wall 1420 and the overlapping portion of the outer casing section 360 therefore forms the second airflow channel 1322 within the interior passage 1330, with the angled rear portion 1422 of the baffle wall 1420 providing the duct 1321 of the second air outlet 1320 that is substantially perpendicular relative to the central axis (X) of the opening/bore 1500 defined by the nozzle 1300. The air inlet into the second airflow channel 1322, as defined by front end of the baffle wall 1421 and the inner surface of the outer casing section 1360, is substantially perpendicular to the central axis (X) of the opening/bore 1500 defined by the nozzle 1300.

In the embodiment illustrated in FIGS. 1 to 4, the baffle wall 1420 extends up the elongate sides 1301, 1302 of the interior passage 1330 and around the upper curved section 1303. The elongate sides of the baffle wall 1420 are generally straight; whilst the lower ends of the baffle wall 1420 extend only partially into the lower curved section 1304 until they meet the interior surface of the lower curved section 1304 of the interior passage 1330 so that the primary airflow cannot enter the second airflow channel 1322 via this lower end. A gasket 1423 provided on the front end of the baffle wall 1420 also extends around the lower edge of the baffle wall 1420 to improve the seal formed between the baffle wall 1420 and the interior surface of the lower curved section 1304 of the interior passage 1320.

In addition, the baffle wall 1420 further comprises a projection 1424 at the peak/centre of upper curved section 1303 that extends from the outward facing surface of the baffle wall 1420 to the inner surface of the outer casing section 1360 thereby separating the adjacent portion of the second airflow channel 1322 from the interior passage 1330 and splitting the opening/inlet from the interior passage 1330 into the second airflow channel 1322 into two sections, each opening/inlet section extending up one of the elongate sides 1301, 1302 and partially around the upper curved section 1303 of the interior passage 1330 until they reach the projection 1424 at the peak of the upper curved section 1303.

In the embodiment illustrated in FIGS. 1 to 4, the fan assembly 1000 then comprises a valve 1400 that is arranged to direct the primary airflow to one or both of the first air outlets 1310*a*, 1310*b* and the second air outlet 1320. To do so, the valve 1400 comprises a pair of valve members 1410*a*, 1410*b* that are arranged to direct the primary airflow to one or both of the first air outlets 1310*a*, 1310*b* and the second air outlet 1320 in dependence upon the position of a pair of valve members 1410*a*, 1410*b*. Each valve member 1410*a*, 1410*b* is therefore arranged to be moveable between a first end position in which the valve member directs the primary airflow to a corresponding one of pair of first air outlets 1310*a*, 1310*b* and prevents/obstructs the airflow from reaching the second air outlet 1320, and a second end position in which the valve member directs the primary airflow to the second air outlet 1320 and prevents/obstructs the airflow from reaching the corresponding first air outlet 1310*a*, 1310*b*. When the valve members 1410*a*, 1410*b* are located in-between the first end position and the second end position, the valve members direct a first portion of the primary airflow to the first air outlets 1310*a*, 1310*b* and a second portion of the primary airflow to the second air outlet 1320. The closer the valve members 1410*a*, 1410*b* to the first end position the greater the proportion of the primary airflow that comprises the first portion that is directed to the to the first air outlets 1310*a*, 1310*b*. Conversely, the closer the valve members 1410*a*, 1410*b* to the second end position the greater the proportion of the primary airflow that comprises the second portion that is directed to the to the second air outlet 1320.

In the embodiment illustrated in FIGS. 1 to 5, the valve 1400 is provided within the interior passage 1330 of the nozzle 1300. Consequently, each valve member 1410*a*, 1410*b* is arranged to close-off the second airflow channel 1322 from the remainder of the interior passage 1330 when in the first end position so as to substantially prevent the airflow from entering the second airflow channel 1322, and to close-off a corresponding first airflow channel 1312*a*, 1312*b* from the remainder of the interior passage 1330 when in the second end position so as to substantially prevent the airflow from entering the first airflow channel 1312*a*, 1312*b*.

Figure 8:
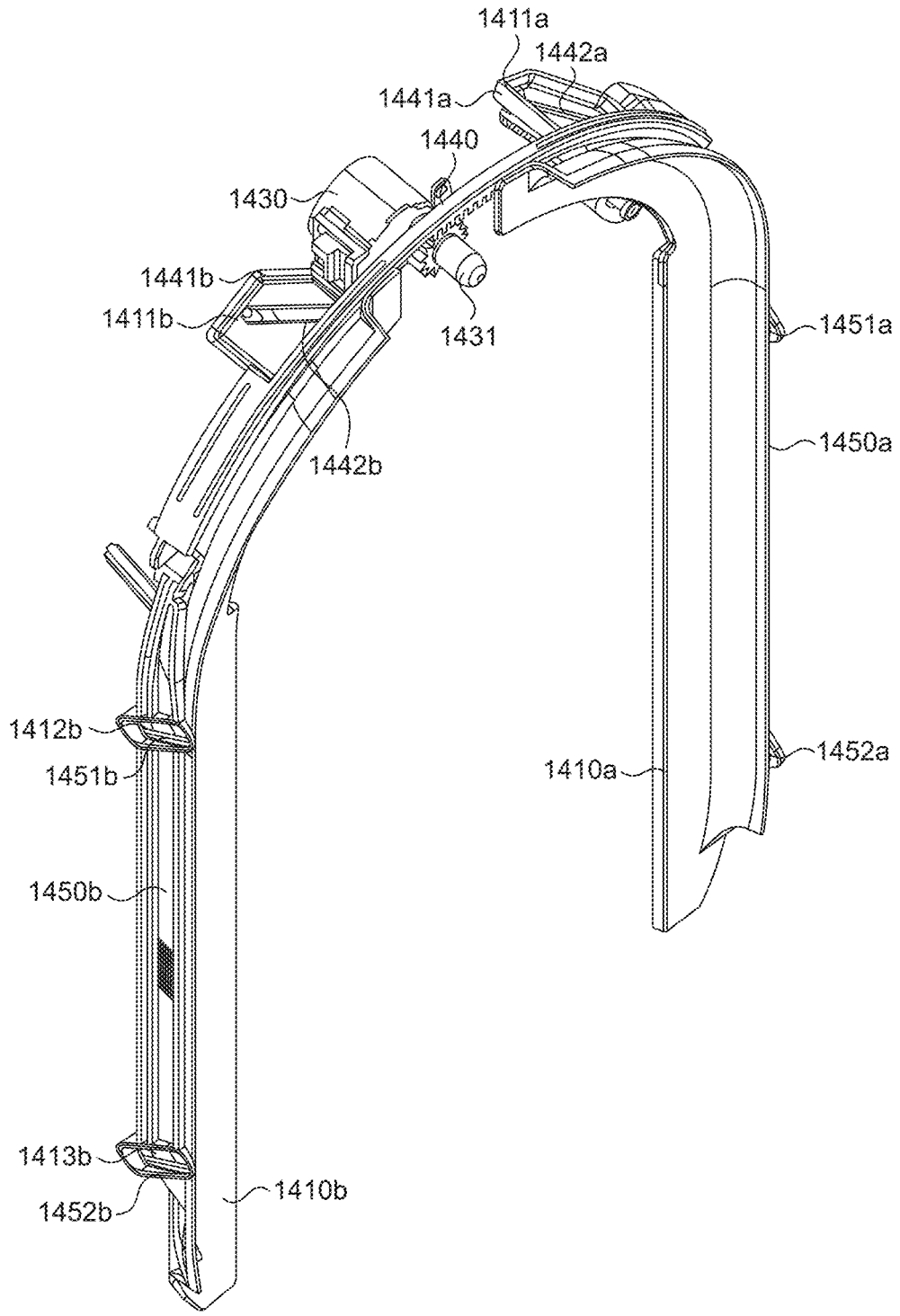
FIG. 8 is a rear perspective view of the valve of the fan assembly of FIGS. 1*a* and 1*b;*

Each valve member 1410*a*, 1410*b* is therefore arranged so that, in the first end position, the valve member 1410*a*, 1410*b* abuts/is seated against both the interior surface of the nozzle 1300 that is adjacent to the second air outlet 1320 and the baffle 1420 to thereby substantially close-off the corresponding inlet section of the second airflow channel 1322 from the remainder of the interior passage 1330. The gasket 1423 provided on the front end of the baffle wall 1420 improves the seal formed between a valve member 1410*a*, 1410*b* and the baffle 1420 when the valve member 1410*a*, 1410*b* is in the first end position. Each valve member 1410*a*, 1410*b* is also arranged so that, in the second end position, the valve member 1410*a*, 1410*b* abuts/is seated against the inner periphery/edges of the frame 1392 of the corresponding heater assembly 1390 to thereby substantially close-off the corresponding first airflow channel 1312*a*, 1312*b* from the remainder of the interior passage 1330, as illustrated in FIG. 4. The shape of each valve member 1410*a*, 1410*b* therefore substantially corresponds to/conforms with/correlates with that of the aligned section/portion of the interior passage 1330. As shown in FIG. 8, which provides an exploded view of the nozzle 1300, each valve member 1410*a*, 1410*b* is therefore generally J-shaped, having an elongate section and a curved end, and also has a generally J-shaped cross-section comprising an elongate section and a curved end.

Figure 9A:
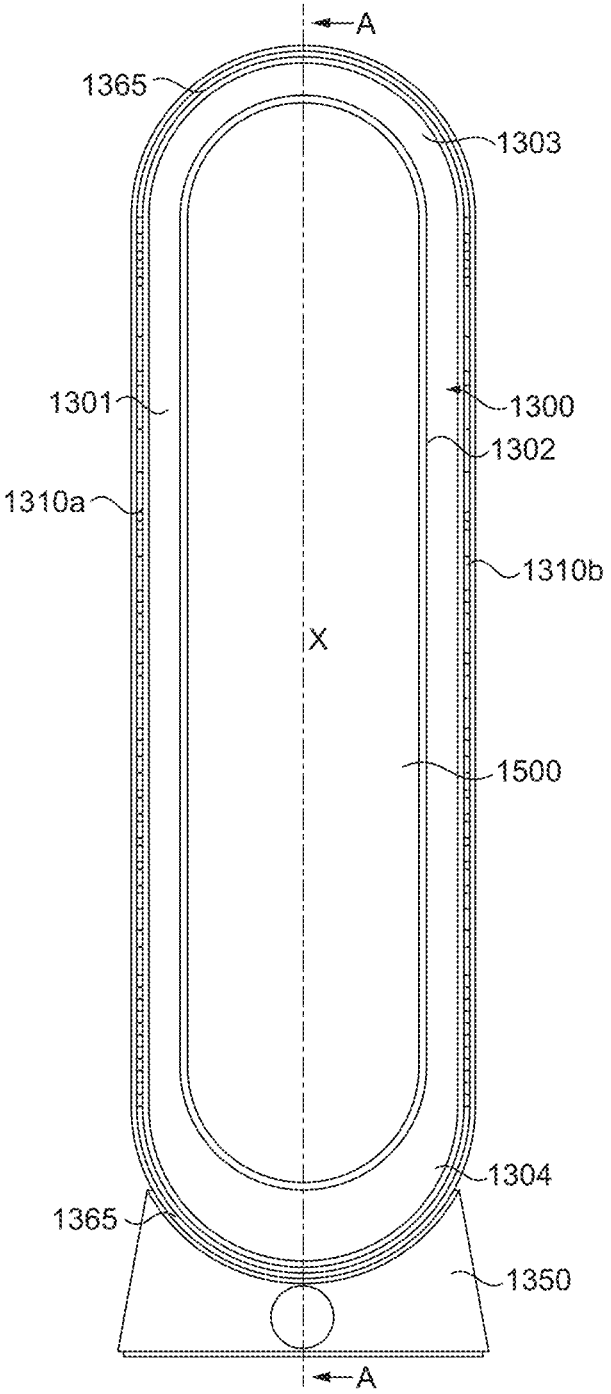
FIG. 9*a* is a front view of a second embodiment of a nozzle for a fan assembly.
Figure 9B:
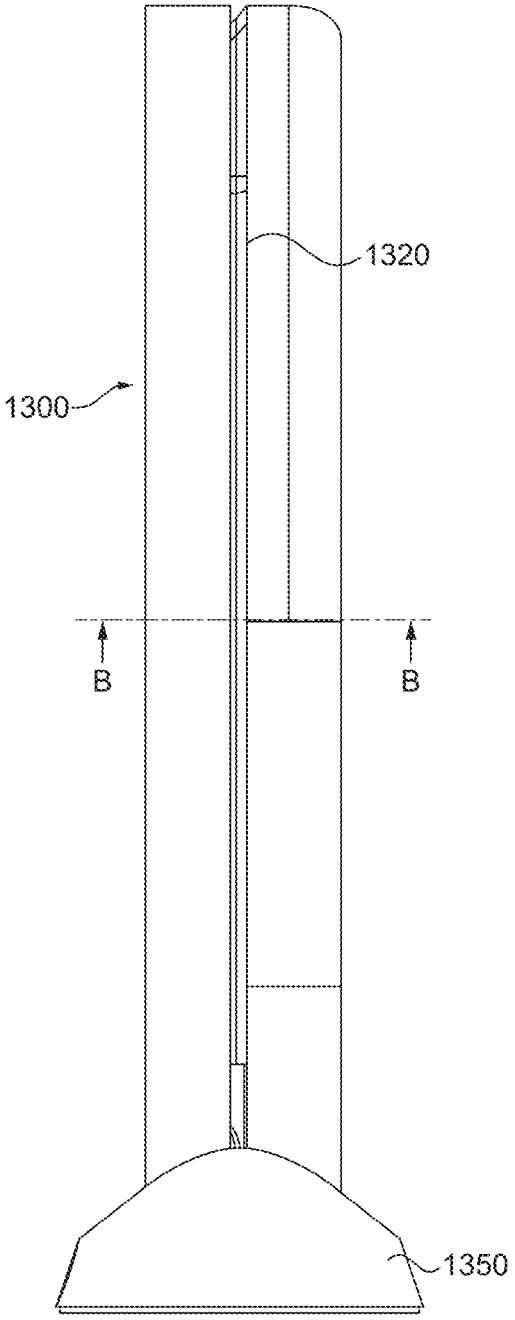
FIG. 9*b* is a right side view of the second embodiment of a nozzle for a fan assembly.

In order to move the valve members 1410*a*, 1410*b* to any position from the first end position to the second end position the fan assembly 1000 is provided with a valve motor 1430 that is arranged to cause movement of the valve members 1410*a*, 1410*b* in response to signals received from the main control circuit 1170. As shown in FIG. 9, the valve motor 1430 is arranged to rotate a pinion 1431 that engages with a curved or arc-shaped rack 1440, with rotation of the valve motor 1430 causing rotation of both the pinion 1431 and the rack 1440, and with the valve 1400 being configured such that rotation of the rack 1440 results in movement of the valve members 1410*a*, 1410*b*.

In the embodiment illustrated in FIGS. 1 to 9, the valve motor 1430 is mounted on the baffle wall 1420 within the interior passage 1330 at the peak/centre of upper curved section 1303, with the baffle wall 1420 then being attached to the rear casing section 1380. A rotating shaft 1432 of the valve motor 1430 then projects towards the rear casing 1380, with the axis of the rotation of the shaft 1432 being parallel to the centre axis (X) of the bore/opening 1500. The pinion 1431 is mounted upon the rotating shaft 1432, with the teeth of the pinion 1431 engaging the arc-shaped rack 1440 whose shape substantially corresponds to/conforms with/correlates with that of the upper curved section 1303 of the interior passage 1330.

As the nozzle 1300 has an elongate annular shape, the rack 1440 has the shape of a minor arc wherein the rack 1440 subtends an angle that is less than 180 degrees. Specifically, the arc-shaped rack 1440 will extend around the majority of the upper curved section 1303 of the interior passage 1330 defined by the nozzle 1300, with the ends of the arc-shaped rack 1440 each being aligned with the respective elongate sides 1301, 1302 of the interior passage 1330 when mounted within the nozzle 1300

As described above, the inlets into each of the first airflow channels 1312*a*, 1312*b* and the corresponding inlet sections of the second airflow channel 1322 are aligned with one another and are substantially parallel to the central axis (X) of the opening/bore 1500 of the nozzle 1300. Consequently, in order for the valve members 1410*a*, 1410*b* to close off the second airflow channel 1322 when in the first end position and to close off the first airflow channels 1312*a*, 1312*b* when in the second end position, the valve members 1410*a*, 1410*b* are each arranged to move in a direction that is substantially parallel to the central axis (X) of the opening/bore 1500. The valve 1400 is therefore configured such that the rotation of the rack 1440 is translated into movement of the valve members 1410*a*, 1410*b* in a direction that is parallel to the central axis (X) of the opening/bore 1500.

In order to translate the rotation of the rack 1440 into movement of the valve members 1410*a*, 1410*b* in a direction that is parallel to the central axis (X) of the bore 1500, the arc-shaped rack 1440 illustrated in FIGS. 8 and 9 is provided with a pair of surfaces 1441*a*, 1441*b* that project from the rack 1440 in a direction that is parallel to the centre axis (X) of the bore 1500, with each of these projecting surfaces 1441*a*, 1441*b* being curved so as to follow the curvature of the arc-shaped rack 1440, and with the rack 1440 being configured such that the pair of surfaces 1441*a*, 1441*b* are located on opposite sides of the pinion 1431 when the pinion 1431 is engaged in the rack 1440. Each of these projecting surfaces 1441*a*, 1441*b* is then provided with a linear cam in the form of a cam slot 1442*a*, 1442*b* that extends across the curved surface at an angle of approximately 45 degrees relative to the axis of the rotation of the rack 1440, and that is arranged to be engaged by a follower pin 1411*a*, 1411*b* that projects from the corresponding valve member 1410*a*, 1410*b*, with the cam slots 1442*a*, 1442*b* provided on both of the projecting surfaces being angled in the same direction.

In addition, a first of a pair of valve actuators 1450*a* is rotatably connected/attached to a first end of the arc-shaped rack 1440 and a second of the pair of valve actuators 1450*b* is rotatably connected/attached to an opposite, second end of the arc-shaped rack 1440. Each valve actuator 1450*a*, 1450*b* is elongate (being arranged to extend along the elongate sides 1301, 1302 of the interior passage 1330) and is provided with an upper cam slot 1451 provided towards the upper end of the valve actuator 1450*a*, 1450*b* and a lower cam slot 1452 provided towards the lower end of the valve actuator 1450*a*, 1450*b*. The upper and lower cam slots 1451, 1452 extend across the corresponding valve actuator 1450*a*, 1450*b* at an angle of approximately 45 degrees relative to the centre axis (X) of the bore 1500 and are each arranged to be engaged by a follower pin 1412, 1413 that projects from the corresponding valve member 1410*a*, 1410*b*. The cam slots 1451*a*, 1452*a* on a first of the valve actuators 1450*a* are angled upwards as the cam slots extend from the back to the front of the valve actuator 1450*a*, whereas the cam slots 1451*b*, 1452*b* on a second of the valve actuators 1450*b* are angled downwards as the cam slots extend from the back to the front of the valve actuator 1450*b*.

Each valve member 1410*a*, 1410*b* therefore comprises three follower pins 1411, 1412, 1413 that are arranged to engage with the cam slot 1442 provided on the corresponding portion of the rack 1440 and the upper and lower cam slots 1451, 1452 provided on the corresponding valve actuator 1450*a*, 1450*b* respectively.

In order to move the valve members 1410*a*, 1410*b* to any position from the first end position to the second end position, the main control circuit 1170 sends a signal to the valve motor 1430 that causes the motor to rotate the shaft 1432 in one direction or the other, thereby causing rotation of the pinion 1431 provided on the shaft 1432. Engagement of the pinion 1431 with the arc-shaped rack 1440 therefore causes the rack 1440 to rotate in the same direction as the shaft 1432. Rotation of the arc-shaped rack 1440 therefore causes the angled cam slots 1442 provided on the curved surfaces 1441*a*, 1441*b* that project from the rack 1440 to move relative to the follower pin 1411 of the corresponding valve member 1410*a*, 1410*b* that is engaged within the cam slot, with the angle of the cam slots 1442*a*, 1442*b* translating the rotational movement of the arc-shaped rack 1440 into linear movement of the valve members 1410*a*, 1410*b* in a direction that is parallel to the centre axis (X) of the bore 1500. In particular, rotation of the arc-shaped rack 1440 will cause both the projecting surfaces 1441*a*, 1441*b* to rotate in the same direction. In this regard, as the cam slots 1442*a*, 1442*b* provided on the curved surfaces 1441*a*, 1441*b* that project from the rack 1440 are angled in the same direction, rotation of the curved surfaces 1441*a*, 1441*b* in the same direction is translated into horizontal movement of the first valve member 1410*a* and second valve member 1410*b* in the same direction.

In addition, rotation of the arc-shaped rack 1440 results in vertical displacement of the first and second ends of the arc-shaped rack 1440 that in-turn causes vertical displacement of the valve actuators 1450*a*, 1450*b* that are rotatably connected to the ends of the arc-shaped rack 1440. In particular, rotation of the arc-shaped rack 1440 will cause upwards movement of one of the first and second ends of the arc-shaped rack 1440 and the connected valve actuator 1450*a*, 1450*b*, and downwards movement of the other of the first and second ends of the arc-shaped rack 1440 and the connected valve actuator 1450*a*, 1450*b*. Vertical displacement of the valve actuators 1450*a*, 1450*b* causes the angled cam slots 1451, 1452 provided on the valve actuators 1450*a*, 1450*b* to move relative to the respective follower pins 1412, 1413 of the corresponding valve member 1410*a*, 1410*b*, with the angle of the cam slot 1451, 1452 translating the vertical displacement of the valve actuators 1450*a*, 1450*b* into horizontal movement of the valve members 1410*a*, 1410*b* in a direction that is parallel to the centre axis (X) of the bore 1500. In this regard, as the cam slots 1451*a*, 1452*a* provided on the first valve actuator 1450*a* are angled in the opposite direction to those provided on the second valve actuator 1450*b*, movement of the first valve actuator 1450*a* and the second valve actuator 1450*b* in opposing vertical directions is translated into horizontal movement of the first valve member 1410*a* and second valve member 1410*b* in the same direction.

To operate the fan assembly 1000 the user presses button on a user interface. The user interface may be provided on the fan assembly 1000 itself, on an associated remote control (not shown), and/or on a wireless computing device such as a tablet or smartphone (not shown) that communicates with the fan assembly 1000 wirelessly. This action by the user is communicated to the main control circuit 1170, in response to which the main control circuit 1170 activates the fan motor 1152 to rotate the impeller 1150. The rotation of the impeller 1150 causes a primary airflow to be drawn into the body 1100 through the air inlet 1110 via the purifying assemblies 1200. The user may control the speed of the fan motor 1152, and therefore the rate at which air is drawn into the body 1100 through the air inlet 1110, by manipulating the user interface. The primary airflow passes sequentially through the purifying assemblies 1200, air inlet 1110, the impeller housing 1154 and the air vent 1115 at the open upper end of the main body section 1120 to enter the interior passage 1330 of the nozzle 1300 via the air inlet 1340 located in the base 1350 of the nozzle 1300.

Within the interior passage 1330, the primary airflow is divided into two air streams which pass in opposite angular directions around the bore 1500 of the nozzle 1300, each within a respective straight section 1301, 1302 of the interior passage 1330. As the air streams pass through the interior passage 1330, air is emitted through one or both of the first air outlets 1310*a*, 1310*b* and the second air outlet 320 in dependence upon the position of the valve members 1410*a*, 1410*b* of the valve 1400.

In the embodiment illustrated in FIGS. 1 to 9, when both of the valve members 1410*a*, 1410*b* provided in the interior passage 1330 are in the first end position, the elongate section of the generally J-shaped cross-section of the valve members 1410*a*, 1410*b* will be in contact with the gasket 1423 provided on the front end of the baffle wall 1420, whilst the curved end of the generally J-shaped cross-section of the valve member 1410*a*, 1410*b* will be in contact with the overlapping portion of the inner surface of the outer casing section 1360. The valve members 1410*a*, 1410*b* will therefore substantially close-off the inlets into the second airflow channel 1322 from the remainder of the interior passage 1330 so as to substantially prevent the airflow from entering the second airflow channel 1322, and will therefore direct the entirety primary airflow to the first air outlets 1310*a*, 1310*b*. When both of the valve members 1410*a*, 1410*b* provided in the interior passage 1330 are in the second end position, the elongate section of the generally J-shaped cross-section of the valve members 1410*a*, 1410*b* will be in contact with the inner periphery/edges of the frame 1392 of the corresponding heater assembly 1390*a*, 1390*b*. The valve members 1410*a*, 1410*b* will therefore substantially close-off the first airflow channels 1312*a*, 1312*b* from the remainder of the interior passage 1330, and will therefore direct the entirety primary airflow to the second air outlet 1320. When both of the valve members 1410*a*, 1410*b* are located in-between the first end position and the second end position, then both the first airflow channels 1312*a*, 1312*b* and the second airflow channel 1322 will be open to the remainder of the interior passage 1330, with a first portion of the primary airflow being directed to the first air outlets 1310*a*, 1310*b* and a second portion of the primary airflow being directed to the second air outlet 1320.

The emission of the primary airflow or a portion of the primary airflow from the first air outlets 1310*a*, 1310*b* in a direction that is substantially parallel to a central axis (X) of the opening/bore 1500 defined by the nozzle 1300 causes a secondary airflow to be generated by the entrainment of air from the external environment, specifically from the region around the nozzle 1300. This secondary airflow combines with the primary airflow emitted from the first air outlets 1310*a*, 1310*b* to produce a combined, amplified airflow that is projected forward from the nozzle 1300. In contrast, emission of the primary airflow from the second air outlet 1320 such that the primary airflow substantially radiates/divaricates away from the fan assembly 1000 prevents this airflow from drawing air from outside the fan assembly 1000 through the opening/bore 1500 defined by the nozzle 1300, thereby producing a non-amplified airflow.

Figure 10A:
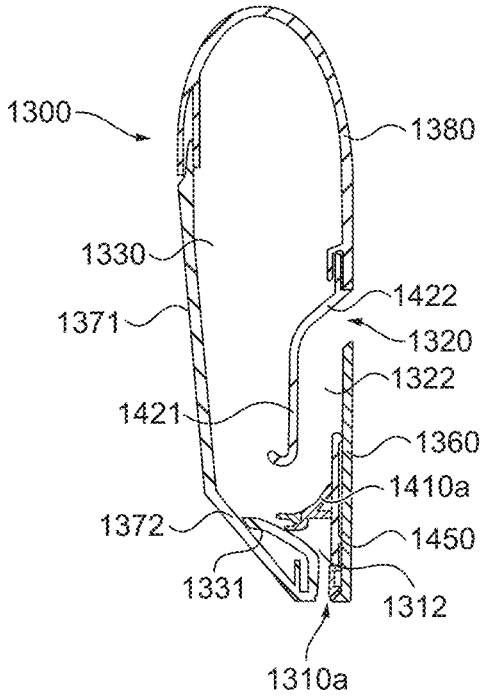
FIG. 10*a* is a cross-sectional view through one section of the nozzle of FIGS. 9*a* and 9*b* taken along line B-B in FIG. 9*b* when in a first mode of operation.
Figure 10B:
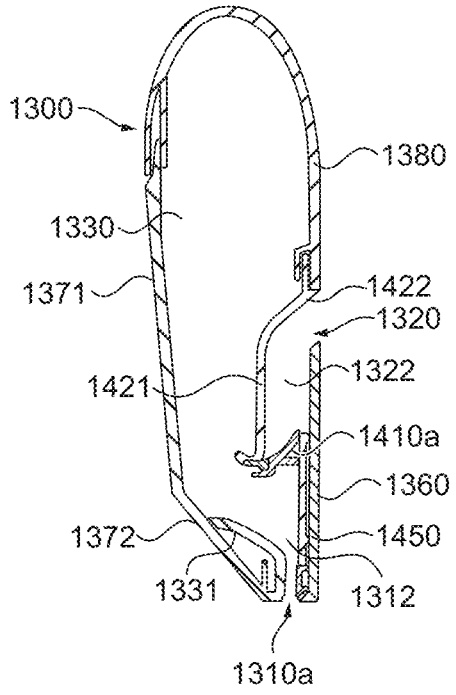
FIG. 10*b* is a cross-sectional view through one section of the nozzle of FIGS. 9*a* and 9*b* taken along line B-B in FIG. 9*b* when in a second mode of operation.
Figure 11:
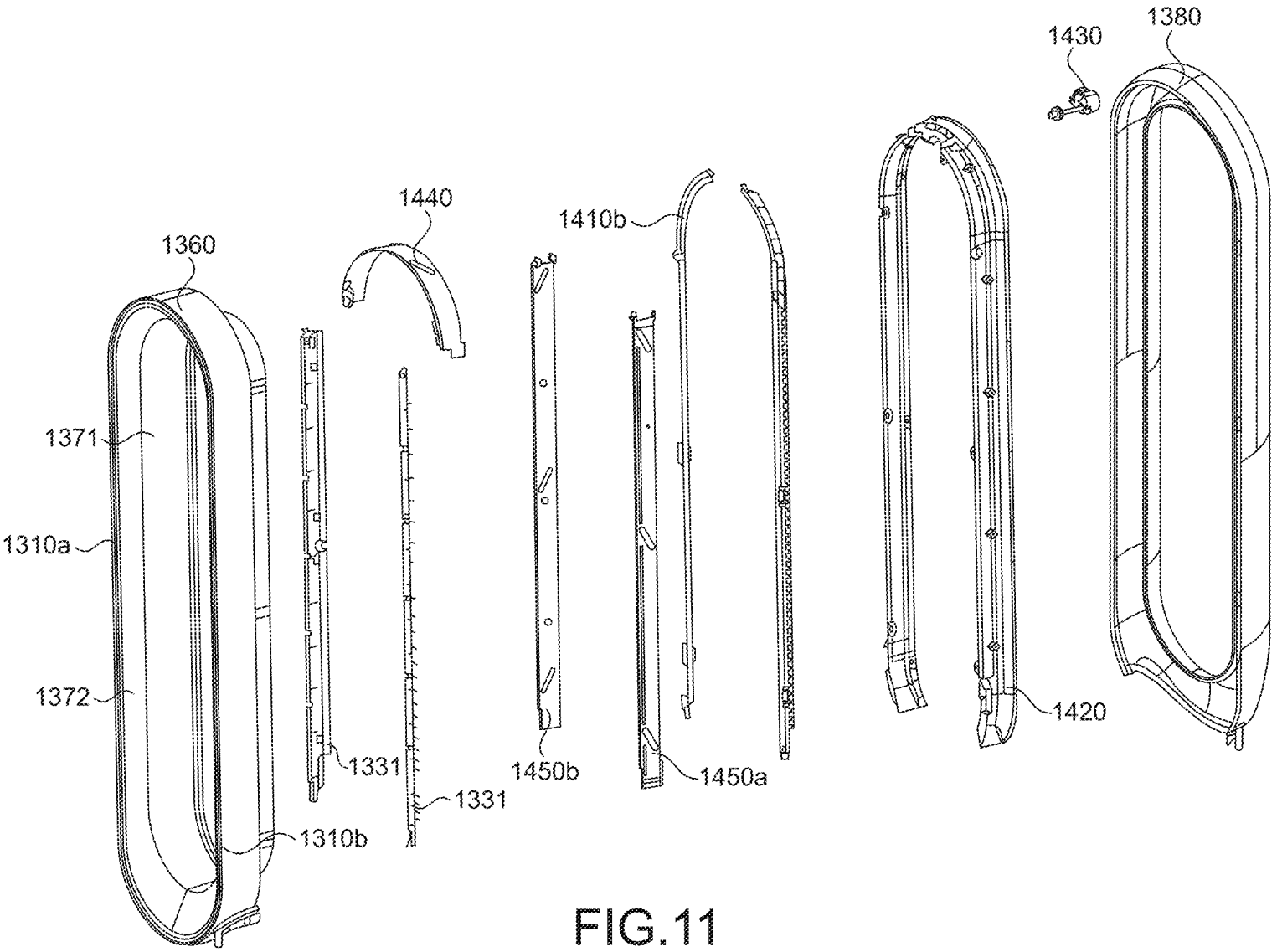
FIG. 11 is an exploded view of the nozzle of FIGS. 9*a* and 9*b;*
Figure 12:
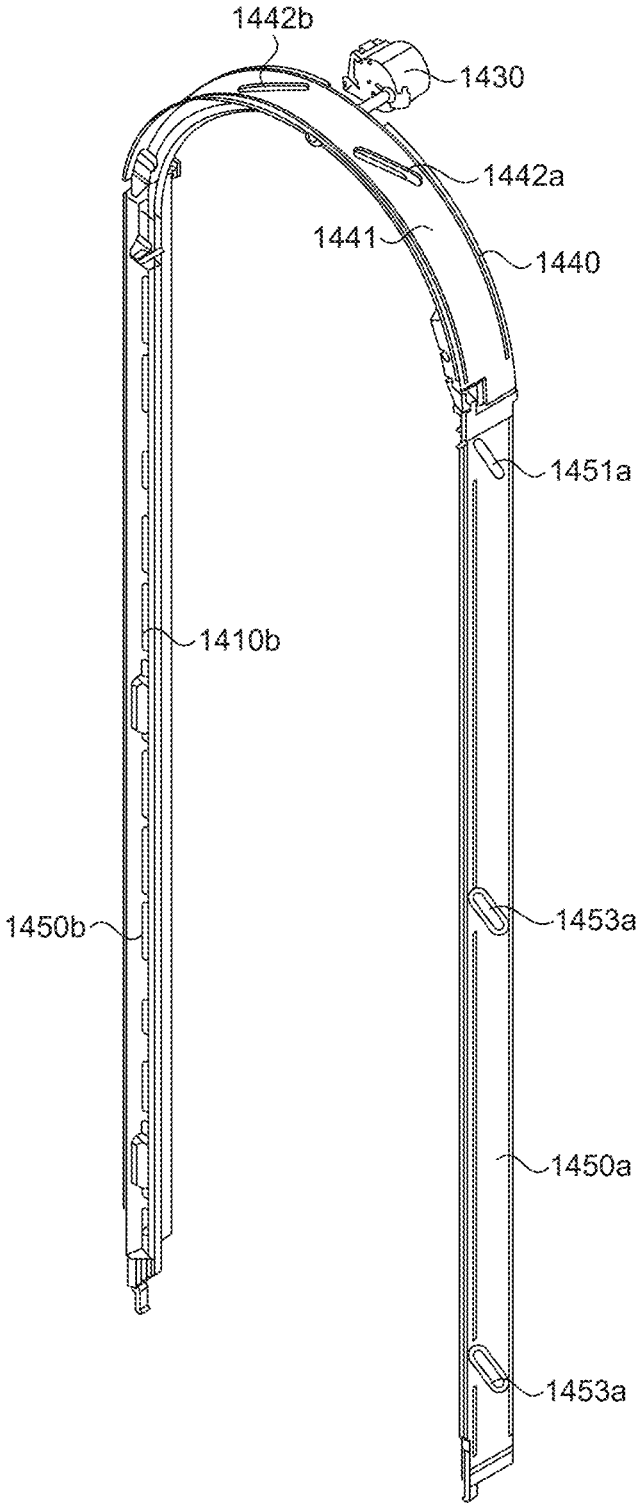
FIG. 12 is a front perspective view of the valve of the of the nozzle of FIGS. 9*a* and 9*b;*

FIGS. 10 and 11 are external views of a nozzle 1300 of a second embodiment of a free-standing environmental control fan assembly 1000, and FIGS. 12*a* and 12*b* show sectional views through line A-A of FIG. 11. In this second embodiment, the body 1100 of fan assembly 1000 is substantially the same as that of the first embodiment and has therefore not been further illustrated nor described. In addition, the nozzle 1300 of this second embodiment is also substantially the same as that of the first embodiment and corresponding reference numerals have therefore been used for like or corresponding parts or features of these embodiments.

In this second embodiment, the nozzle 1300 is mounted on the upper end of the main body section 1120 over the air vent 1115 through which the primary airflow exits the body 1100. As with the first embodiment, the nozzle 1300 comprises a neck/base 1350 that connects to upper end of the main body section 1120, and has an open lower end which provides an air inlet 1340 for receiving the primary airflow from the body 1100. The external surface of the base 1350 of the nozzle 1300 is then substantially flush with the outer edge of the upper annular flange 1121 of the main body section 1120.

The only significant difference between the first embodiment and the second embodiment is that the second embodiment does not include heater assemblies 1390*a*, 1390*b* within the interior passage 1330 adjacent to the first air outlets 1310*a*, 1310*b*. As a consequence, the fan assembly 1000 of the second embodiment does not include the frames of the heater assemblies 1392*a*, 1392*b* that funnel the primary airflow towards the first air outlets 1310*a*, 1310*b* and that therefore defines first airflow channels 1312*a*, 1312*b* within the interior passage 1330 of the nozzle 1300. In contrast, the fan assembly 1000 of the second embodiment comprises one or more airflow guide members 1331*a*, 1331*b* that are arranged, when mounted within the interior passage 1330, to direct the airflow out of the corresponding first air outlet 1310*a*, 1310*b*.

To do so, each airflow guide member 1331*a*, 1331*b* comprises a front end that is fitted within the corresponding first air outlet 1310*a*, 1310*b* provided in the forward facing edge of the nozzle 1300, and that therefore forms the duct 1311 of the first air outlet 1310*a*, 1310*b*, and with a rear surface that is angled relative to the front end. This angled rear surface of the each airflow guide member 1331*a*, 1331*b* therefore funnels the primary airflow towards the corresponding first air outlet 1310*a*, 1310*b* and the duct 1311 of the first air outlet 1310*a*, 1310*b* that is provided by the front end of the airflow guide member 1331*a*, 1331*b*. The first airflow channels 1312*a*, 1312*b* within the interior passage 1330 of the nozzle 1300 are therefore at least partially defined by a respective airflow guide member 1331*a*, 1331*b*. The valve 1400 is therefore arranged so that, in the second end position, the valve members 1410*a*, 1410*b* abut/are seated against the angled surface of the corresponding airflow guide member 1331*a*, 1331*b* and against a surface of the corresponding valve actuator 1450*a*, 1450*b*, the valve actuator 1450*a*, 1450*b* being located within the interior passage 1330 adjacent to the inner surface of the outer casing 1360, to thereby substantially close-off the first airflow channel 1312*a*, 1312*b* from the remainder of the interior passage 1330, as illustrated in FIG. 12*a*. In addition, the valve 1400 is arranged so that, in the first end position, the valve members 1410*a*, 1410*b* abut/are seated against both the front end of the baffle wall 1420 and against the surface of the corresponding valve actuator 1450*a*, 1450*b* that is adjacent to the second air outlet 1320 to thereby substantially close-off the second airflow channel 1322 from the remainder of the interior passage 1330, as illustrated in FIG. 12*b*.

Figure 13B:
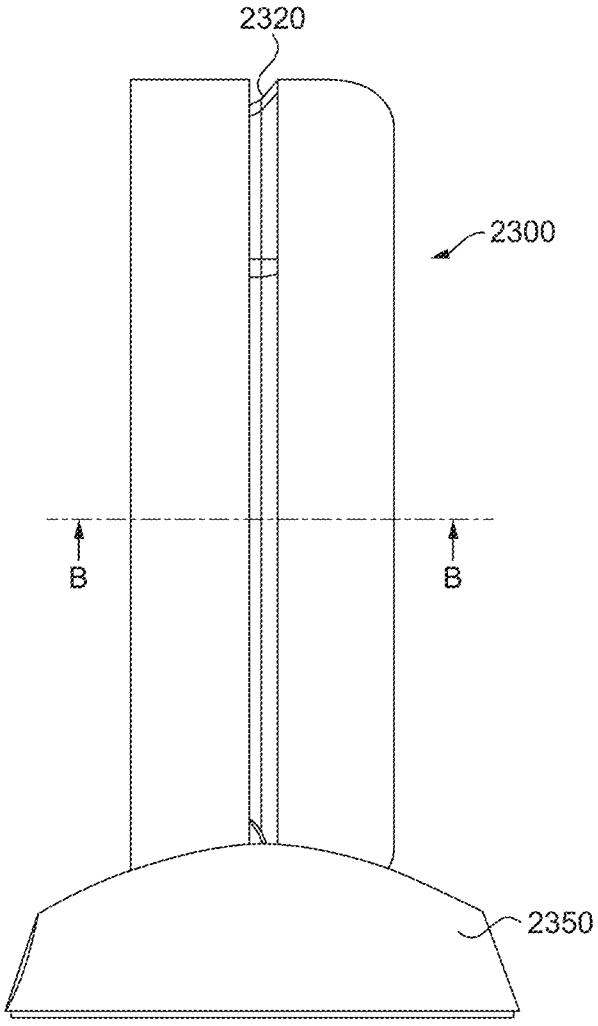
FIG. 13*b* is a right side view of the third embodiment of a nozzle for a fan assembly.
Figure 13A:
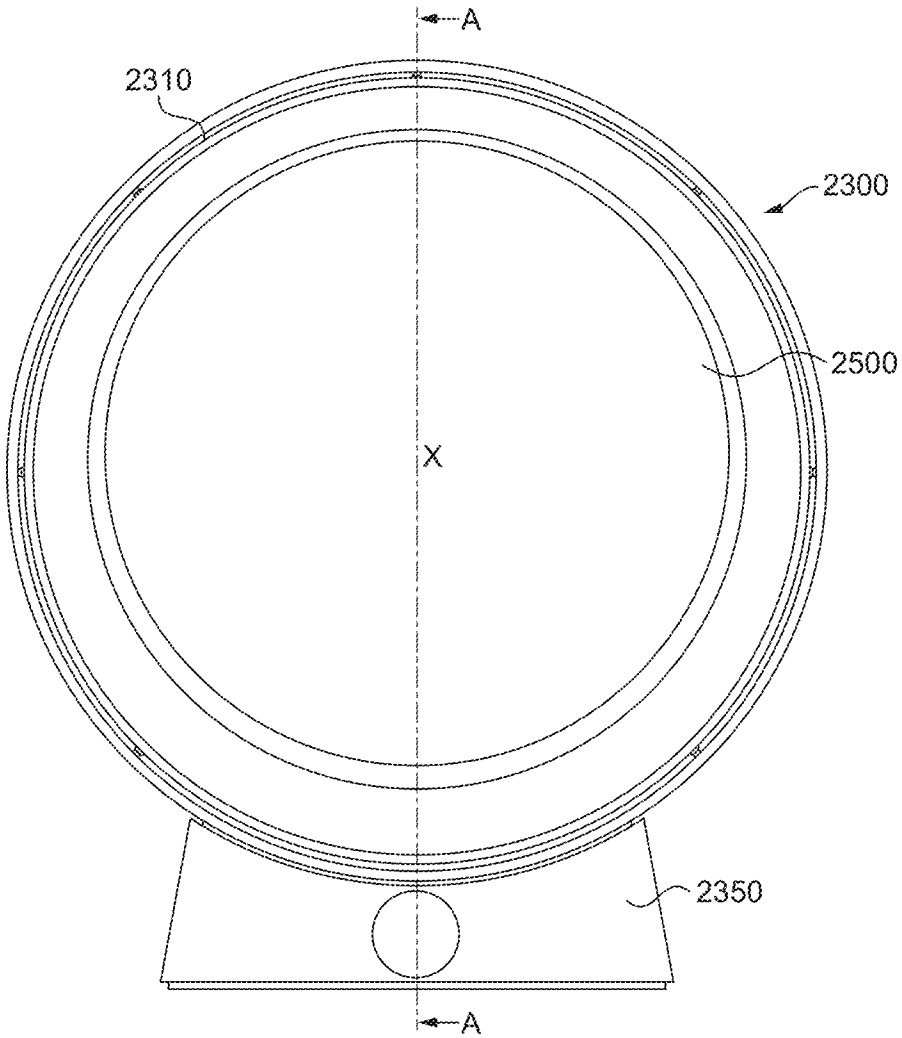
FIG. 13*a* is a front view of a third embodiment of a nozzle for a fan assembly.
Figure 14A:
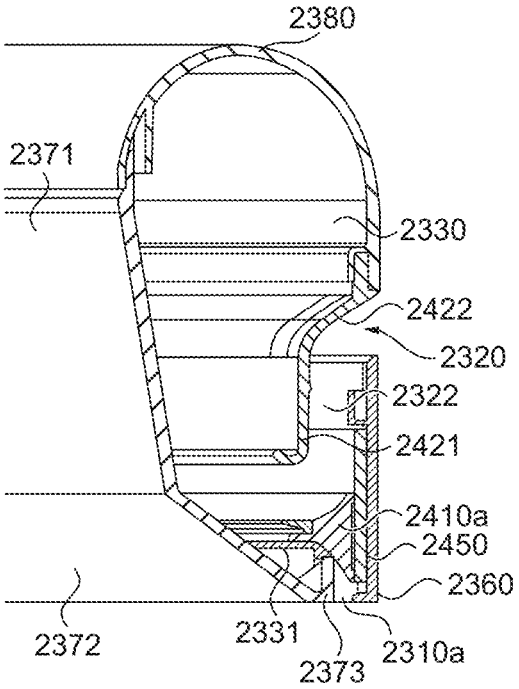
FIG. 14*a* is a cross-sectional view through one section of the nozzle of FIGS. 9*a* and 9*b* taken along line B-B in FIG. 13*b* when in a first mode of operation.
Figure 14B:
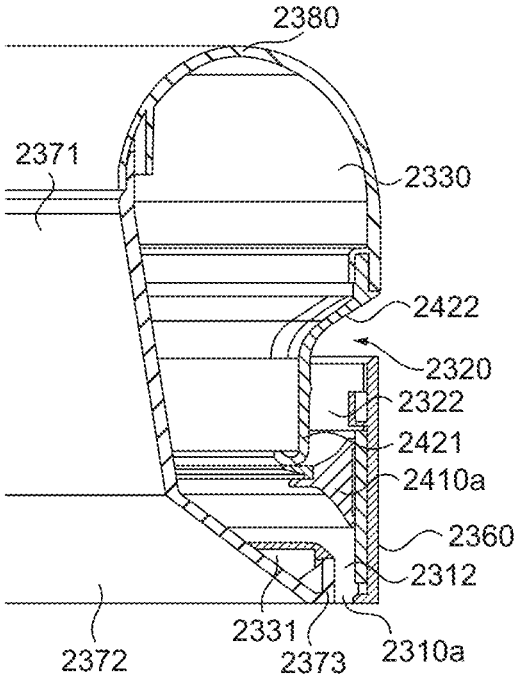
FIG. 14*b* is a cross-sectional view through one section of the nozzle of FIGS. 9*a* and 9*b* taken along line B-B in FIG. 13*b* when in a second mode of operation.

Another difference between the first embodiment and the second embodiment is that in the second embodiment the arc-shaped rack 1440 is not provided with a pair of surfaces 1441*a*, 1441*b* that project from the rack 1440 in a direction that is parallel to the centre axis (X) of the bore 1500. As illustrated in FIGS. 13 and 14, in the second embodiment the arc-shaped rack 1440 is provided with a single surface 1441 that projects from the rack 1440 in a direction that is parallel to the centre axis (X) of the bore 1500, and that extends along the length of the arc-shaped rack 1440. This projecting surface 1441 is then provided with two linear cams, each in the form of a cam slot 1442*a*, 1442*b* that extends across the curved surface at an angle of approximately 45 degrees relative to the axis of the rotation of the rack 1440, and with the rack 1440 being configured such the cam slots 1442*a*, 1442*b* are located on opposite sides of the pinion 1431 when the pinion 1431 is engaged in the rack 1440. The cam slots 1442*a*, 1442*b* are each arranged to be engaged by a follower pin 1411*a*, 1411*b* that projects from the corresponding valve member 1410*a*, 1410*b*, with the cam slots 1442*a*, 1442*b* being angled in the same direction.

A first of a pair of valve actuators 1450*a* is rotatably connected/attached to a first end of the arc-shaped rack 1440 and a second of the pair of valve actuators 1450*b* is rotatably connected/attached to an opposite, second end of the arc-shaped rack 1440. Each valve actuator 1450*a*, 1450*b* is elongate (being arranged to extend along the elongate sides 1301, 1302 of the interior passage 1330) and is provided with an upper cam slot 1451 provided towards the upper end of the valve actuator 1450*a*, 1450*b*, a lower cam slot 1452 provided towards the lower end of the valve actuator 1450*a*, 1450*b*, and a middle cam slot 1453 provided towards the middle of the valve actuator 1450*a*, 1450*b*. The upper, lower and middle cam slots 1451, 1452, 1453 extend across the corresponding valve actuator 1450*a*, 1450*b* at an angle of approximately 45 degrees relative to the centre axis (X) of the bore 1500 and are each arranged to be engaged by a follower pin 1412, 1413, 1414 that projects from the corresponding valve member 1410*a*, 1410*b*. The cam slots 1451*a*, 1452*a*, 1453*a* on a first of the valve actuators 1450*a* are angled upwards as the cam slots extend from the back to the front of the valve actuator 1450*a*, whereas the cam slots 1451*b*, 1452*b*, 1453*b* on a second of the valve actuators 1450*b* are angled downwards as the cam slots extend from the back to the front of the valve actuator 1450*b*.

Each valve member 1410*a*, 1410*b* therefore comprises four follower pins 1411, 1412, 1413, 1414 that are arranged to engage with the cam slot 1442 provided on the corresponding portion of the rack 1440 and the upper, lower and middle cam slots 1451, 1452, 1453 provided on the corresponding valve actuator 1450*a*, 1450*b* respectively.

The operation of the valve, including the movement of the valve members 1450*a*, 1450*b*, of the second embodiment is implemented in substantially the same way as that described above for the first embodiment and has therefore not been further described.

Figure 15:
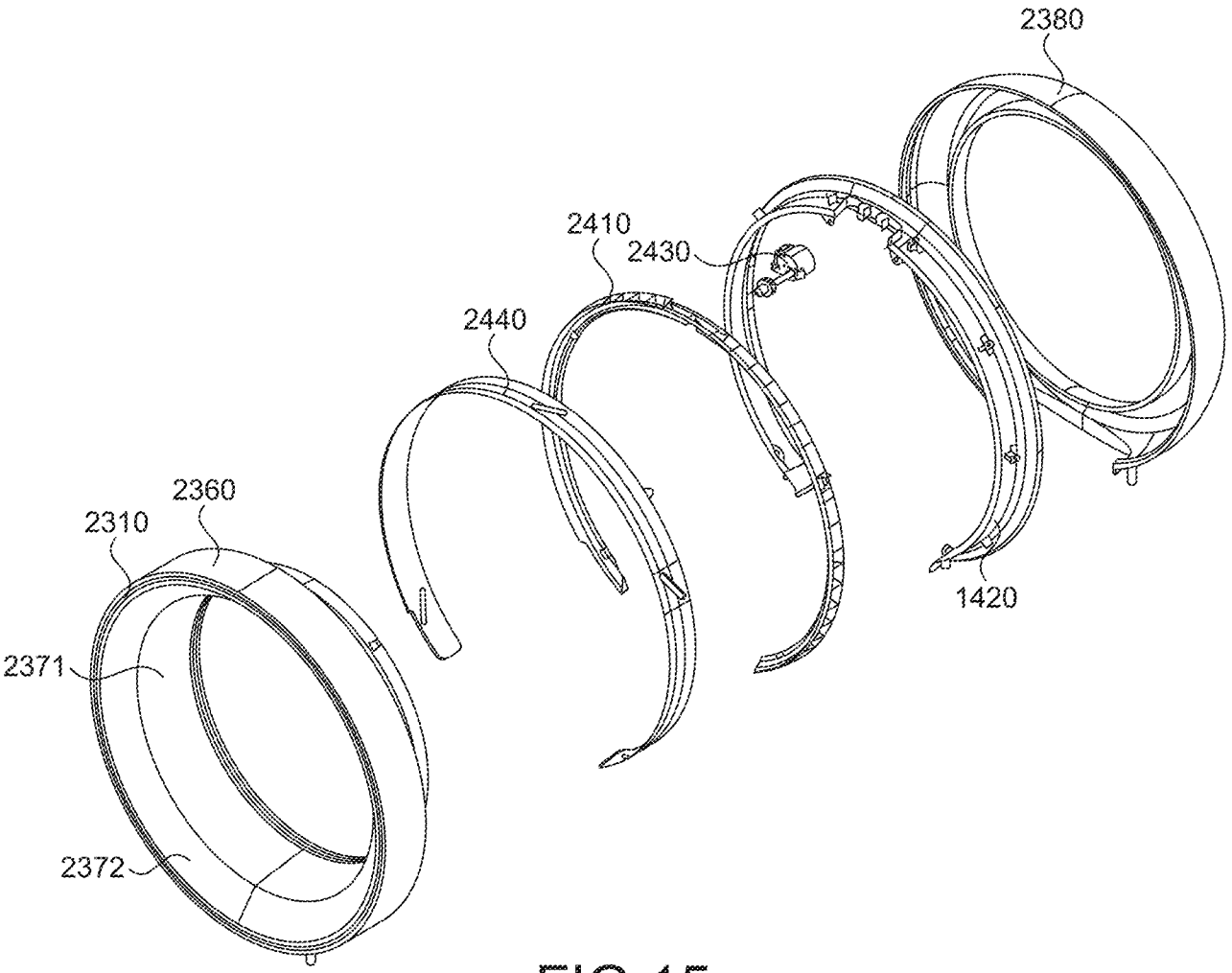
FIG. 15 is an exploded view of the nozzle of FIGS. 13*a* and 13*b*.
Figure 16:
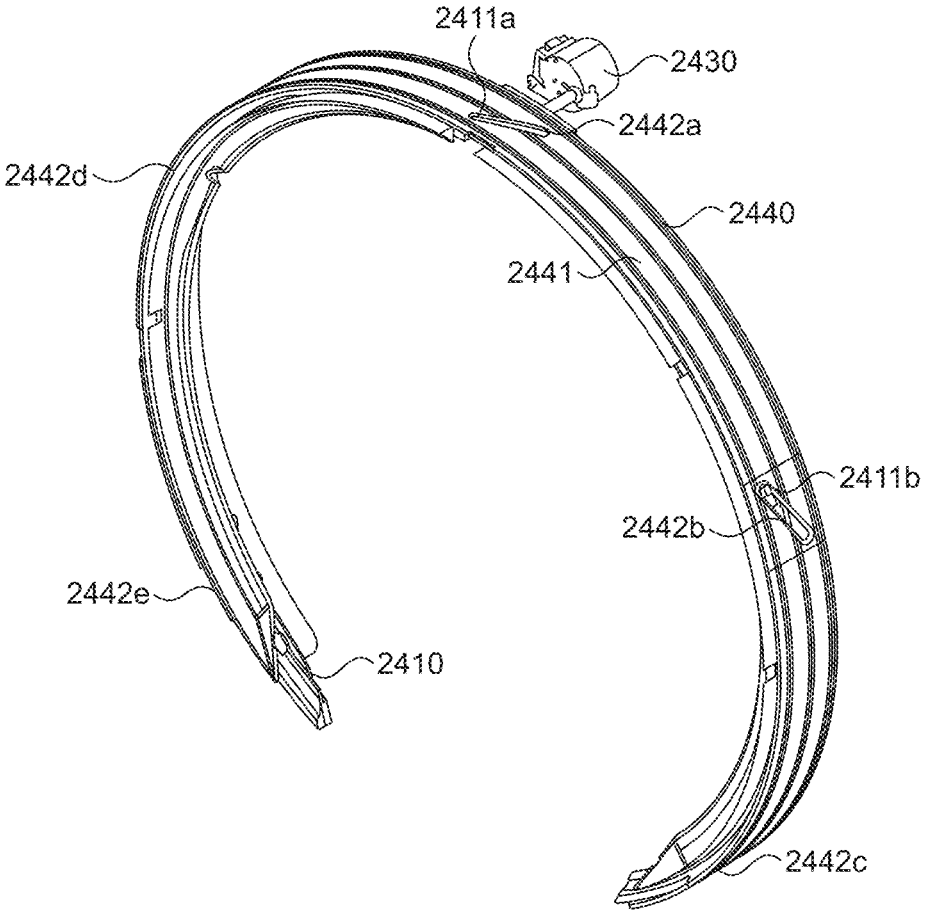
FIG. 16 is a front perspective view of the valve of the nozzle of FIGS. 13*a* and 13*b*.

FIGS. 15 and 16 are external views of a nozzle 2300 of a third embodiment of a free-standing environmental control fan assembly 1000, and FIGS. 17*a* and 17*b* show sectional views through line A-A of FIG. 15. In this third embodiment, the body 1100 of fan assembly 1000 is substantially the same as that of the first and second embodiments and has therefore not been further illustrated nor described. However, rather than having an elongate annular shape, the nozzle 2300 of this third embodiment is annular/generally cylindrical in shape such that there are differences in the construction of the nozzle 2300 and also differences in the valve 2400 provided within the interior passage 2330 of the nozzle 2300.

In this third embodiment, the nozzle 2300 is mounted on the upper end of the main body section 1120 over the air vent 1115 through which the primary airflow exits the body 1100. The nozzle 2300 comprises a neck/base 2350 that connects to upper end of the main body section 1120, and has an open lower end which provides an air inlet 2340 for receiving the primary airflow from the body 1100. The external surface of the base 2350 of the nozzle 1300 is then substantially flush with the outer edge of the upper annular flange 1121 of the main body section 1120.

In the embodiment illustrated in FIGS. 15 to 19, the nozzle 2300 comprises an annular/cylindrical outer casing section 2360 that is concentric with and extends about an annular/generally cylindrical inner casing section 2370. In this example, the inner casing section 2370 and the outer casing section 2360 are separate components; however, they could also be integrally formed as a single piece. The nozzle 2300 also has a curved rear casing section 2380 that forms the rear of the nozzle 2300, with an inner end of the curved rear casing section 2380 being connected to a rear end of the inner casing section 2370. In this example, the inner casing section 2370 and the curved rear casing section 2380 are separate components that are connected together, for example, using screws and/or adhesives; however, they could also be integrally formed as a single piece. The curved rear casing section 2380 has a generally annular/cylindrical cross-section perpendicular to the central axis (X) of the inner bore 2500 of the nozzle 2300, and a generally semi-circular cross-section parallel to the central axis (X) of the inner bore 2500 of the nozzle 2300.

The inner casing section 2370 has a generally annular/cylindrical cross-section perpendicular to the central axis (X) of the inner bore 2500 of the nozzle 2300, and extends around and surrounds the inner bore 2500 of the nozzle 2300. In this example, the inner casing section 2370 has a rear portion 2371 and a front portion 2372. The rear portion 2371 is angled outwardly from the rear end of the inner casing section 2370 away from the central axis (X) of the inner bore 2500. The front portion 2372 is also angled outwardly from the rear end of the inner casing section 2370 away from the central axis (X) of the inner bore 2500, but with a greater angle of inclination than that of the rear portion 2371. The front portion 2372 of the inner casing section 2370 therefore tapers towards the front end of the outer casing section 2360, but does not meet the front end of the outer casing section 2360, with the space between the front end of the inner casing section 2370 and the front end of the outer casing section 2360 defining a slot that forms a first air outlet 2310 of the nozzle 2300.

The outer casing section 2360 then extends from the front of the nozzle 2300 towards an outer end of the curved rear casing section 2380, but does not meet the outer end of the curved rear casing section 2380, with the space between a rear end of the outer casing section 2360 and the outer end of the curved rear casing section 2380 defining a slot that forms a second air outlet 2320 of the nozzle 2300.

The outer casing section 2360, inner casing section 2370 and curved rear casing section 2380 therefore define an interior passage 2330 for conveying air from an air inlet 2340 of the nozzle 2300 to one or both of the first air outlet 2310 and the second air outlet 2320. In other words, the interior passage 2330 is bounded by the internal surfaces of the outer casing section 2360, inner casing section 2370 and curved rear casing section 2380. The interior passage 2330 may be considered to comprise first and second sections which each extend in opposite directions about the bore 2500, as the air that enters the nozzle 2300 through the air inlet 2340 will enter the nozzle 2300 and be divided into two air streams which each flow in opposite directions around the interior passage 2330 of the nozzle 2300.

As described above, the first air outlet 2310 takes the form of a slot provided by the space between the front end of the inner casing section 2370 and the front end of the outer casing section 2360. The nozzle 2300 therefore comprises a single first air outlet 2310 that is provided in the forward facing edge of the nozzle 2300 and extends around the majority of the periphery of the central bore 2500 for emitting the primary airflow towards the front of the nozzle 2300.

In order for the airflow emitted from the first air outlet 2310 to draw air from outside the fan assembly 1000 and combine with this air to produce an amplified airflow, the first air outlet 2310 is arranged to direct the emitted the airflow in a direction that is substantially parallel to the central axis (X) of the opening/bore 2500 defined by the nozzle 2300, i.e. at an angle from −30 to 30 degrees away from the central axis, preferably at an angle from −20 to 20 degrees away from the central axis, and more preferably at an angle from −10 to 10 degrees away from the central axis. To do so, the first air outlet 2310 is arranged such that a duct 2311 of the first air outlet 2310 is substantially parallel to the central axis (X) of the opening/bore 2500 defined by the nozzle 2300. The inner casing section 2370 is therefore provided with a projection 2373 that extends inwardly into the interior passage 2330 of the nozzle 2300 from the front end of the inner casing section 2370 that is immediately adjacent to space between the front end of the inner casing section 2370 and the front end of the outer casing section 2360. This inwardly extending projection 2373 together with the opposing inner surface of the outer casing section 2360 therefore defines the duct 2311 of the first air outlet 2310 that is substantially parallel to the central axis (X) of the bore/opening 2500. An airflow guide member 2331 is then provided within the interior passage 2330 that extends from the inner end of the inwardly extending projection 2373 to an adjacent portion of the inner surface of the inner casing section 2370. This airflow guide member 2331 therefore assist in directing the primary airflow towards the first air outlet 2310 and the duct 2311 of the first air outlet 2310 that is partially defined by the inwardly extending projection 2373. A first airflow channel 2312 within the interior passage 2330 of the nozzle 2300 is therefore at least partially defined by the airflow guide member 2331.

The second air outlet 2320 is then arranged such that a duct 2321 of the second air outlet 2320 is substantially perpendicular relative to the central axis (X) of the opening/bore 2500 defined by the nozzle 2300. As a consequence, the non-amplified airflow emitted from the second air outlet 2320 will be directed substantially perpendicularly away from the central axis (X) of the opening/bore 2500 defined by the nozzle 2300. As illustrated in FIGS. 17*a* and 17*b*, the duct 2321 of the second air outlet 2320 extends from the interior passage 2330 that carries the primary airflow received from the body 1100 to the external periphery of the nozzle 2300 in a direction that is substantially perpendicular to the direction of the air drawn through the bore 2500.

In the embodiment illustrated in FIGS. 17*a* and 17*b*, a baffle 2420 is provided within the interior passage that defines a second airflow channel 2322 within the interior passage 2330 that is arranged to direct the primary airflow towards the second air outlet 23200. The baffle 2420 extends into the interior passage 2330 from an interior surface of the nozzle 2300 that at least partially defines the interior passage 2330, with the second airflow channel 2322 being a section of the interior passage 2330 that is on one side of the baffle 2420. In particular, the second airflow channel 2332 comprises a section of the interior passage 2330 that is bounded by the baffle 2420 and by a portion of the interior surface of the nozzle 2300 that is adjacent to the second air outlet 2320.

The baffle 2420 is provided by a baffle wall that extends into the interior passage 2330 from the curved rear casing section 2380. The baffle wall 2420 is connected to the outer end of the curved rear casing section 2380 and has a front portion 2421 and a rear portion 2422. The rear portion 2422 of the baffle wall 2420 is angled inwardly from the outer end of the curved rear casing section 2380 towards the central axis (X) of the bore 2500. The front portion 2421 is then angled relative to the rear portion 2422 so that the front portion 2421 is parallel to the outer casing section 2360, with the majority of the front portion 2421 overlapping the outer casing section 2360. The portion of the interior passage 2330 that is located between the front portion 2421 of the baffle wall 2420 and the overlapping portion of the outer casing section 2360 therefore forms the second airflow channel 2322 within the interior passage 2330, with the angled rear portion 2422 of the baffle wall 2420 providing the duct 2321 of the second air outlet 2320 that is substantially perpendicular relative to the central axis (X) of the opening/bore 2500 defined by the nozzle 2300. The air inlet into the second airflow channel 2322, as defined by front end of the baffle wall 2420 and the inner surface of the outer casing section 2360, is substantially parallel to the central axis (X) of the opening/bore 2500 defined by the nozzle 2300.

In the embodiment illustrated in FIGS. 17*a* and 17*b*, the baffle wall 2420 extends around the majority of the interior passage 2330. The lower ends of the baffle wall 2420 are angled away from the central axis (X) of the opening/bore 2500 so that they meet the interior surface of the lower section of the interior passage 2330 so that the primary airflow cannot enter the second airflow channel 2322 via this lower end.

In this third embodiment, the nozzle 2300 comprises a valve 2400 that is arranged to direct the primary airflow to one or both of the first air outlet 2310 and the second air outlet 2320. To do so, the valve 2400 comprises a single valve member 2410 that is arranged to direct the primary airflow to one or both of the first air outlet 2310 and the second air outlet 2320 in dependence upon the position of the valve member 2410. The valve member 2410 is therefore arranged to be moveable between a first end position in which the valve member 2410 directs the primary airflow to the first air outlet 2310 and prevents/obstructs the airflow from reaching the second air outlet 2320, and a second end position in which the valve member 2410 directs the primary airflow to the second air outlet 2320 and prevents/obstructs the airflow from reaching the first air outlet 2310. When the valve member 2410 is located in-between the first end position and the second end position, the valve member 2410 directs a first portion of the primary airflow to the first air outlet 2310 and a second portion of the primary airflow to the second air outlet 2320. The closer the valve member 2410 to the first end position the greater the proportion of the primary airflow that comprises the first portion that is directed to the to the first air outlet 2310. Conversely, the closer the valve member 2410 to the second end position the greater the proportion of the primary airflow that comprises the second portion that is directed to the to the second air outlet 2320.

In this third embodiment, the valve 2400 is provided within the interior passage 2330 of the nozzle 2300. Consequently, the valve member 2410 is arranged to close-off the second airflow channel 2322 from the remainder of the interior passage 2330 when in the first end position so as to substantially prevent the airflow from entering the second airflow channel 2322, and to close-off a first airflow channel 2312 from the remainder of the interior passage 2330 when in the second end position so as to substantially prevent the airflow from entering the first airflow channel 2312.

In order to move the valve member 2410 to any position from the first end position to the second end position the fan assembly 1000 is provided with a valve motor 2430 that is arranged to cause movement of the valve member 2410 in response to signals received from the main control circuit 1170. As shown in FIG. 18, the valve motor 2430 is arranged to rotate a pinion 2431 that engages with an arc-shaped rack 2440, with rotation of the valve motor 2430 causing rotation of both the pinion 2431 and the rack 2440, and with the valve 2400 being configured such that rotation of the rack 2440 results in movement of the valve member 2410.

The valve motor 2430 is mounted on the baffle wall 2420 within the interior passage 2330 at the peak/top of the interior passage 2330, with the baffle wall 2420 then being attached to the rear casing section 2380. A rotating shaft 2432 of the valve motor 2430 then projects towards the rear casing 2380, with the axis of the rotation of the shaft 2432 being parallel to the centre axis (X) of the bore/opening 2500. The pinion 2431 is mounted upon the rotating shaft 2432, with the teeth of the pinion 2431 engaging the arc-shaped rack 2440 whose shape substantially corresponds to/conforms with/correlates with that of the interior passage 2330 of the annular/cylindrical nozzle 2300.

As the nozzle 2300 is annular/cylindrical in shape, the rack 2440 has the shape of a major arc wherein the rack 2440 subtends an angle that is greater than 180 degrees. Specifically, the arc-shaped rack 2440 will extend around the majority of the interior passage 2330 defined by the nozzle 2300, with the space between the ends of the arc-shaped rack 2440 being aligned with the air inlet 2340 when mounted within the interior passage 2330 of the nozzle 2300

The inlet into the first airflow channel 2312 and the inlet of the second airflow channel 2322 are aligned with one another and are substantially parallel to the central axis (X) of the opening/bore 2500 of the nozzle 2300. Consequently, in order for the valve member 2410 to close off the second airflow channel 2322 when in the first end position and to close off the first airflow channel 2312 when in the second end position, the valve member 2410 is each arranged to move in a direction that is substantially parallel to the central axis (X) of the opening/bore 2500. The valve 2400 is therefore configured such that the rotation of the rack 2440 is translated into movement of the valve member 2410 in a direction that is parallel to the central axis (X) of the opening/bore 2500.

In order to translate the rotation of the rack 2440 into movement of the valve member 2410 in a direction that is parallel to the central axis (X) of the bore 2500, the arc-shaped rack 2440 illustrated in FIGS. 18 and 19 is provided with a single surface 2441 that projects from the rack 2440 in a direction that is parallel to the centre axis (X) of the bore 2500, and that extends along the length of the arc-shaped rack 2440. The projecting surface 2441 is then provided with five linear cams distributed evenly around the length of the arc-shaped rack 2440, each linear cam being in the form of a cam slot 2442*a-e* that extends across the curved surface at an angle of approximately 45 degrees relative to the axis of the rotation of the rack 2440. In this third embodiment, the rack 2440 is configured such that one of the five the cam slots 2242*a* is located at the mid-point along the length of the rack 2440, adjacent to the location at which the pinion 2431 engages in the rack 2440 and opposite to the air inlet 2340. The four further cam slots 2442*b*, 2442*c*, 2442*d*, 2442*e* are then distributed on either side of the middle cam slot 2442*a* such that two of these cam slots are located on each half of the rack 2440, such that there are two slots located either side of the pinion 2431 when the pinion 2431 is engaged in the rack 2440. The cam slots 2442*a-e* are each arranged to be engaged by a corresponding follower pin 2411*a-e* that projects from the valve member 2410, with all of the cam slots 2442*a-e* being angled in the same direction.

In order to move the valve member 2410 to any position from the first end position to the second end position, the main control circuit 1170 sends a signal to the valve motor 2430 that causes the motor to rotate the shaft 2432 in one direction or the other, thereby causing rotation of the pinion 2431 provided on the shaft 2432. Engagement of the pinion 2431 with the arc-shaped rack 2440 therefore causes the rack 2440 to rotate in the same direction as the shaft 2432. Rotation of the arc-shaped rack 2440 therefore causes the angled cam slots 2442*a-e* provided on the curved surface 2441 of the rack 2440 to move relative to the corresponding follower pins 2411*a-e* of the valve member 2410, with the angle of the cam slots 2442*a-e* translating the rotational movement of the arc-shaped rack 2440 into linear movement of the valve member 2410 in a direction that is parallel to the centre axis (X) of the bore 2500.

The valve 2400 is therefore arranged so that, in the second end position, the valve member 2410 abuts/is seated against the surface of the airflow guide member 2331 and against a surface of the arc-shaped rack 2440 that is located within the interior passage 2330 adjacent to the inner surface of the outer casing 2360, to thereby substantially close-off the first airflow channel 2312 from the remainder of the interior passage 2330, as illustrated in FIG. 17*a*. In addition, the valve 2400 is arranged so that, in the first end position, the valve member 2410 abuts/is seated against both the front end of the baffle wall 2420 and against the surface of the arc-shaped rack 2440 that is adjacent to the second air outlet 2320 to thereby substantially close-off the second airflow channel 2322 from the remainder of the interior passage 2330, as illustrated in FIG. 17*b*.

When the valve member 2410 is located in-between the first end position and the second end position, the valve member 2410 directs a first portion of the primary airflow to the first air outlet 2310 and a second portion of the primary airflow to the second air outlet 2320. The closer the valve member 2410 to the first end position the greater the proportion of the primary airflow that comprises the first portion that is directed to the first air outlet 2310. Conversely, the closer the valve member 2410 to the second end position the greater the proportion of the primary airflow that comprises the second portion that is directed to the to the second air outlet 2320.

The emission of the primary airflow or a portion of the primary airflow from the first air outlet 2310 in a direction that is substantially parallel to a central axis (X) of the opening/bore 2500 defined by the nozzle 2300 causes a secondary airflow to be generated by the entrainment of air from the external environment, specifically from the region around the nozzle 2500. This secondary airflow combines with the primary airflow emitted from the first air outlet 2310 to produce a combined, amplified airflow that is projected forward from the nozzle 2300. In contrast, emission of the primary airflow from the second air outlet 2320 such that the primary airflow substantially radiates/divaricates away from the fan assembly 1000 prevents this airflow from drawing air from outside the fan assembly 1000 through the opening/bore 2500 defined by the nozzle 2300, thereby producing a non-amplified airflow.

The fan assemblies described herein can therefore deliver either an amplified airflow or a non-amplified airflow or simultaneously deliver both an amplified airflow and a non-amplified airflow, and in doing so provides the user of the fan assembly with various options as to how air is delivered by the fan assembly. This is particularly useful when the fan assembly is configured to provide purified air as the user of a fan assembly may wish to continue to receive purified air from the fan assembly without the cooling effect produced by the provision of the amplified airflow. For example, this may be the case in winter when the user may consider the temperature to be too low to make use of the cooling effect provided by the amplified airflow. Similarly, if the fan assembly is configured to provide heated air, then the user of a fan assembly may wish to continue to receive purified air from the fan assembly without the need for a focussed, amplified airflow, with a non-directional, non-amplified airflow then being delivered by the second air outlet.

For example, should the user wish to receive purified air from the fan assembly without the cooling effect produced by the provision of the amplified airflow, then the user can control the air delivery mode by manipulating the user interface. In response to these user inputs, the main control circuit would then cause the one or more valve members to prevent or obstruct the airflow from reaching the one or more first air outlets, so that the entirety of the primary airflow is directed out through one or more second air outlets. The fan assembly would then produce only the non-amplified airflow. Alternatively, the user may wish to only partially reduce the cooling effect produced by the provision of the amplified airflow. In this case, the user inputs would instruct the main control circuit to cause the valve member to move so as to reduce the proportion of the primary airflow that is directed to the one or more first air outlets, whilst increasing the proportion of the primary airflow that is directed to the one or more second air outlets.

Moreover, in the above described embodiments the one or more second air outlets of the fan assembly are configured to direct the non-amplified airflow such that it substantially radiates/divaricates perpendicularly away from a central axis of the bore defined by the nozzle. These embodiments therefore also provide that the non-amplified airflow is emitted diffusely, thereby providing for indirect delivery of the primary airflow to the user. In contrast, the one or more first air outlets of the fan assembly is configured to direct the emitted the airflow so that it is substantially parallel to a central axis of the bore defined by the nozzle, thereby providing for a more direct, focussed delivery of the amplified airflow to the user. The more diffuse delivery of the non-amplified airflow by the one or more second air outlets may also be desirable so as to further minimise the cooling effect produced by the provision of the focussed, amplified airflow.

It will be appreciated that individual items described above may be used on their own or in combination with other items shown in the drawings or described in the description and that items mentioned in the same passage as each other or the same drawing as each other need not be used in combination with each other. In addition, the expression "means" may be replaced by actuator or system or device as may be desirable. In addition, any reference to "comprising" or "consisting" is not intended to be limiting in any way whatsoever and the reader should interpret the description and claims accordingly.

Furthermore, although the invention has been described in terms of preferred embodiments as set forth above, it should be understood that these embodiments are illustrative only. Those skilled in the art will be able to make modifications and alternatives in view of the disclosure which are contemplated as falling within the scope of the appended claims. For example, those skilled in the art will appreciate that the above-described invention might be equally applicable to other types of environmental control fan assemblies, and not just free standing fan assemblies. By way of example, such a fan assembly could be any of a freestanding fan assembly, a ceiling or wall mounted fan assembly and an in-vehicle fan assembly.

By way of further example, whilst the above described embodiments all provide that the nozzle comprises the second air outlet, the second air outlet could be provided on the body/stand of the fan assembly or in the neck of the of the nozzle that connects to the body/stand of the fan assembly, with the valve then be arranging to direct the airflow accordingly.

As a yet further example, whilst the first embodiment illustrated in FIGS. 1 to 9 includes heater assemblies within the first airflow channel that are configured to heat the primary airflow as it passes through the first airflow channel to the first air outlets, the fan assemblies described herein could alternatively or in addition be provided with one or more heater assemblies within the second airflow channel that would then be configured heat the primary airflow as it passes through the second airflow channel to the second air outlets.

In addition, whilst the above described embodiments all provide a valve motor for driving the movement of the valve member of the valve, the nozzles described herein could alternatively include a manual mechanism for driving the movement of the valve member, wherein the application of a force by the user would be translated into movement of the valve member. For example, this could take the form of a rotatable dial or wheel or a sliding dial or switch, with rotation or sliding of the dial by a user causing rotation of the shaft, pinion and rack.

Furthermore, from the above described embodiments it is clear that the fan assembly could comprise one or more first outlets and/or one or more second air outlets. In the case that the fan assembly comprises more than one first air outlet and/or more than one second air outlet, the fan assembly could then comprise either a single valve member for directing the primary airflow to one or both of the first air outlet(s) and second air outlet(s) or could comprise a plurality of valve member that between them direct the primary airflow to one or both of the first air outlet(s) and second air outlet(s). For example, the fan assembly could comprise a valve member corresponding to each of the first air outlets and/or each of the second air outlets.

The invention claimed is:

1. A fan assembly comprising: a motor-driven impeller for creating an airflow; a nozzle comprising a first air outlet, the nozzle defining a bore through which air from outside the fan assembly is drawn by any portion of the airflow that is emitted from the first outlet and which combines with the airflow emitted from the first air outlet to produce an amplified airflow; and the fan assembly further comprising a second air outlet arranged such that any portion of the airflow that is emitted from the second air outlet does not draw air through the bore defined by the nozzle thereby producing a non-amplified airflow; wherein the second air outlet faces a plurality of directions, and the second air outlet is arranged to direct any portion of the airflow that is emitted from the second air outlet such that the non-amplified airflow divaricates away from the fan assembly.

2. The fan assembly of claim 1, wherein the nozzle comprises the second air outlet.

3. The fan assembly of claim 2, wherein the second air outlet is arranged to direct any portion of the airflow that is emitted from the second air outlet such that the non-amplified airflow divaricates away from a central axis of the bore defined by the nozzle.

4. The fan assembly of claim 3, wherein the second air outlet is arranged to direct any portion of the airflow that is emitted from the second air outlet perpendicularly away from the central axis of the bore defined by the nozzle.

5. The fan assembly of claim 3, wherein the second air outlet extends around at least a portion of an external surface of the nozzle, and at least one of the plurality of directions, faces in a direction that is perpendicular to a central axis of the bore defined by the nozzle.

6. The fan assembly of claim 1, wherein the first air outlet is arranged to direct the emitted the airflow parallel to a central axis of the bore defined by the nozzle.

7. The fan assembly of claim 1, further comprising:

a valve that is arranged to direct the airflow to one or both of the first air outlet and the second air outlet in dependence upon the position of a valve member of the valve.

8. The fan assembly of claim 7, wherein the valve member is arranged to be moveable between a first end position in which the valve member directs the airflow to the first air outlet and occludes the airflow from reaching the second air outlet, and a second end position in which the valve member directs the airflow to the second air outlet and occludes the airflow from reaching the first air outlet.

9. The fan assembly of claim 8, wherein the valve member is arranged such that, when located in-between the first end position and the second end position, the valve member directs a first portion of the airflow to the first air outlet and a second portion of the airflow to the second air outlet.

10. The fan assembly of claim 7, wherein the nozzle comprises the first air outlet, the second air outlet and an interior passage for conveying the airflow to both the first air outlet and the second air outlet, and the valve is provided within the interior passage of the nozzle.

11. The fan assembly of claim 10, wherein the interior passage is provided with a first airflow channel and a second airflow channel, the first airflow channel being arranged to direct the airflow towards the first air outlet and the second airflow channel being arranged to direct the airflow towards the second air outlet.

12. The fan assembly of claim 11, wherein, in the first end position, the valve member is arranged to occlude the second airflow channel from the remainder of the interior passage and, in the second end position, the valve member is arranged to occlude the first airflow channel from the remainder of the interior passage.

13. The fan assembly of claim 11, wherein a baffle is provided within the interior passage, the baffle at least partially defining at least one of the first airflow channel and the second airflow channel within the interior passage.

14. The fan assembly of claim 13, wherein the valve member is arranged to abut against the baffle in one of the first end position and the second end position to thereby occlude either the first airflow channel or the second airflow channel from the remainder of the interior passage.

15. The fan assembly of claim 7, further comprising a valve driver arranged to cause movement of the valve member to direct the airflow to one or both of the first air outlet and the second air outlet.

16. The fan assembly of claim 15, wherein the valve driver is arranged to cause movement of a rack, the rack being provided with a linkage to the valve member so that movement of the rack causes movement of the valve member.

17. The fan assembly of claim 16, wherein the linkage between the rack and the valve member is provided by a cam-follower pair, a cam being provided on one of the rack and the valve member and a follower being provided on the other of the rack and the valve member and arranged to cooperate with the cam.

18. The fan assembly of claim 15, wherein the valve driver is arranged to cause movement of a valve actuator, the valve actuator being provided with a linkage to a valve member so that movement of the valve actuator causes movement of the valve member.

19. The fan assembly of claim 18, wherein the linkage between the valve actuator and the valve member is provided by a cam-follower pair, a cam being provided on one of the valve actuator and the valve member and a follower being provided on the other of the valve actuator and the valve member and arranged to cooperate with the cam.

20. The fan assembly of claim 18, wherein the valve driver is arranged to cause movement of a rack, the rack being connected to the valve actuator so that movement of the rack causes movement of the valve actuator.

21. The fan assembly of claim 16, wherein the rack has an arc shape that corresponds to that of an aligned portion of the interior passage and the valve driver is arranged to cause circular motion of the rack.

22. The fan assembly of claim 21, wherein a first valve actuator is connected to a first end of the arc-shaped rack and a second valve actuator is connected to a second end of the arc-shaped rack.

23. The fan assembly of claim 22, wherein a cam of a cam-follower pair linking the first valve actuator to a first valve member has an opposing orientation to a cam of a cam-follower pair linking the second valve actuator to a second valve member.

24. A nozzle for a fan assembly, the nozzle comprising: an air inlet for receiving an airflow from the fan assembly; a first air outlet; and a second air outlet; wherein the nozzle defines a bore through which air from outside the fan assembly is drawn by any portion of the airflow that is emitted from the first outlet and which combines with the airflow emitted from the first air outlet to produce an amplified airflow; and wherein the second air outlet is arranged such that any portion of the airflow that is emitted from the second air outlet does not draw air through the bore defined by the nozzle thereby producing a non-amplified airflow;

wherein the second air outlet faces a plurality of directions, and the second air outlet is arranged to direct any portion of the airflow that is emitted from the second air outlet such that the non-amplified airflow divaricates away from the fan assembly.

25. The nozzle of claim 24, further comprising:

a valve that is arranged to direct the airflow to one or both of the first air outlet and the second air outlet in dependence upon the position of a valve member of the valve.

* * * * *